US006753840B2

(12) United States Patent
Aoki

(10) Patent No.: US 6,753,840 B2
(45) Date of Patent: Jun. 22, 2004

(54) IMAGE PROCESSING SYSTEM AND METHOD OF PROCESSING IMAGE DATA TO INCREASE IMAGE QUALITY

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 169 days.

(21) Appl. No.: 09/852,756

(22) Filed: May 11, 2001

(65) Prior Publication Data

US 2002/0005858 A1 Jan. 17, 2002

(30) Foreign Application Priority Data

May 26, 2000 (JP) ..... 2000-156656

(51) Int. Cl.[7] ..... G09G 3/36

(52) U.S. Cl. ..... 345/98; 345/100; 345/92; 345/204

(58) Field of Search ..... 345/87–104, 204; 348/618–620, 700–701, 791, 792, 702

(56) References Cited

U.S. PATENT DOCUMENTS 4,296,436 A * 10/1981 Achiha ..... 358/167
4,307,420 A * 12/1981 Ninomiya et al. ..... 358/136
4,860,105 A * 8/1989 Sakaguchi et al. ..... 358/167
5,119,084 A * 6/1992 Kawamura et al. ..... 340/784
6,243,059 B1 * 6/2001 Greene et al. ..... 345/88
6,329,980 B1 * 12/2001 Uehara et al. ..... 345/204
6,377,235 B1 * 4/2002 Murade et al. ..... 345/100

FOREIGN PATENT DOCUMENTS

| | | |
|---|---|---|
| JP | 04-061317 A | 10/1990 |
| JP | A 6-167692 | 6/1994 |
| JP | A 10-171421 | 6/1998 |
| JP | 10-274967 | 10/1998 |
| JP | 10-274968 A | 10/1998 |
| JP | 11-231836 | 8/1999 |
| JP | 11-231837 | 8/1999 |
| JP | 2000-098981 | 4/2000 |

* cited by examiner

*Primary Examiner*—Lun-Yi Lao
(74) *Attorney, Agent, or Firm*—Oliff & Berridge, PLC

(57) ABSTRACT

An image processing circuit having a delay unit U1 that delays image data Da and outputs image data as image data Db. The delay time of the delay units U1 is equivalent to the unit time of phase-rendered image signals VID1 through VID6. Upon a first difference circuit 31 subtracting image data Db from image data Da, and thus generating first difference image data Ds1, a first coefficient circuit 32 multiplies the first difference image data Ds1 by a first coefficient K1 and generates first correction data Dh1. Corrected image data Dout is generated by adding the image data Da and the first correction data Dh1. Therefore, ghosting is removed in the event of sequentially selecting blocks of batched multiple data lines to make display.

18 Claims, 18 Drawing Sheets

IMAGE PROCESSING SYSTEM AND METHOD OF PROCESSING IMAGE DATA TO INCREASE IMAGE QUALITY

BACKGROUND OF THE INVENTION

1. Field of Invention

The present invention relates to an image processing circuit and image data processing method suitable for use with an electro-optical device, wherein image signals divided into multiple systems and extending in the time-axial direction and maintaining a constant signal level each unit time are supplied to the data lines at a predetermined timing, and to an electro-optical device using the same, and to an electronic apparatus.

2. Description of Related Art

A conventional electro-optical device, such as an active-matrix liquid crystal display device, is described with reference to FIG. 15 and FIG. 16. First, as shown in FIG. 15, the conventional liquid crystal display device comprises a liquid crystal display panel 100, a timing circuit 200, and an image signal processing circuit 300. Of these, the timing circuit 200 is for outputting timing signals described in greater detail below, to be used at each of the units. Also, a D/A converting circuit 301 within the image signal processing circuit 300 converts image data Da supplied from external equipment from digital signals into analog signals, and thus outputs image signals VID. Further, a phase rendering circuit 302 takes input of single-system image signals VID and can render the signals into N-phase (N=6 in the drawing) image signals, which are then output. The image signals can be rendered into N phases to extend the application time of image signals supplied to thin film transistors (hereafter referred to as "TFT") in the later-described sampling circuit, thereby sufficiently securing sampling time for data signals in the TFT panel and discharging time thereof.

On the other hand, an amplifying/inverting circuit 303 inverts the polarity of image signals under the following conditions and amplifies the signals as appropriate, and then supplies the signals as phase-rendered image signals VID1 through VID6 to the liquid crystal display panel 100. Polarity inversion refers to a mutual inversion of voltage levels of the image signals, with the center potential of the amplitude thereof as the reference potential. Also, whether or not to perform inversion is determined according to whether the data signal application method is 1) polarity inversion in units of scanning lines, 2) polarity inversion in units of data signal lines, or 3) polarity inversion in units of pixels, and the inversion cycle thereof is set to one parallel scanning period or dot clock cycle.

Referring now to FIG. 16, the liquid crystal display panel 100 will be described. This liquid crystal display panel 100 is made up of a device substrate and opposing substrate facing one another across a gap, with liquid crystal filled in this gap. Now, the device substrate and opposing substrate can be formed of quartz substrate, hard glass, or the like.

Of these, regarding the device substrate, multiple scanning lines 112 are arrayed in parallel in the X direction in FIG. 16, and orthogonal to this, multiple data lines 114 are arrayed in parallel in the Y direction. Now, the data lines 114 are blocked in units of 6 lines, forming what will be called blocks B1 through Bm. In the following for the sake of facilitating description, reference to data lines in general will be made with the denoting reference numeral as 114, but reference numerals 114*a* through 114*f* will be used in the event of indicating specific data lines.

The gate electrode of each TFT 116, serving as a switching device for example, is connected to each intersection between the scanning lines 112 and data lines 114, while the source electrodes of the TFTs 116 are connected to the data lines 114, and the drain electrodes of the TFTs 116 are connected to the pixel electrodes 118. Each pixel is made up of a pixel electrode 118, a shared electrode formed on the opposing substrate, and the liquid crystal sandwiched between these electrodes, forming a matrix array at each intersection between the scanning lines 112 and data lines 114. Also, holding capacity (omitted in drawing) is formed in a state connected to each pixel electrode 118.

Now, a scanning driving circuit 120 is formed on the device substrate, so as to sequentially output pulse scanning signals to the scanning lines 112, based on the clock signals CLY from the timing circuit 200, inverted clock signals thereof CLYinv, transfer starting pulses DY, etc. In more detail, the scanning driving circuit 120 sequentially shifts the transfer starting pulses DY supplied at the start of the vertical scanning period according to the clock signal CLY and the inverted clock signals thereof CLYinv, and outputs these as scanning line signals, whereby the scanning lines 112 are sequentially selected.

On the other hand, the sampling circuit 130 has one sampling switch 131 for each data line 114 at the end of the data lines 114. The switches 131 are formed of TFTs formed on the same device substrate, and image signals VID1 through VID6 are input to the source electrodes of the switches 131 via the image signals supplying lines L1 through L6. The gate electrodes of the six switches 131 connected to the data lines 114*a* through 114*f* of block B1 are connected to signals lines to which sampling signals S1 are supplied, the gate electrodes of the six switches 131 connected to the data lines 114*a* through 114*f* of block B2 are connected to signals lines to which sampling signals S2 are supplied, and so on up to the gate electrodes of the six switches 131 connected to the data lines 114*a* through 114*f* of block Bm being connected to signals lines to which sampling signals Sm are supplied. Now, the sampling signals S1 through Sm are each for sampling the image signals VID1 through VID6 by block within a horizontal valid display period.

Also, the shift register circuit 140 is formed on the same device substrate, and sequentially outputs the sampling signals S1 through Sm based on the clock signals CLX, the inverted clock signals thereof CLXinv, and the transfer starting pulses DX and the like from the timing circuit 200. In more detail, the shift register circuit 140 sequentially shifts the transfer starting pulses DX supplied at the beginning of the horizontal scanning period according to the clock signals CLX and the inverted clock signals thereof CLXinv, and sequentially outputs these as sampling signals S1 through Sm.

With such a configuration, at the point that the sampling signal S1 is output, the six data lines 114*a* through 114*f* belonging to the block B1 have the image signals VID1 through VID6 thereof sampled, and the image signals VID1 through VID6 are each written to the six pixels of the scanning line currently selected by the corresponding TFTs 116.

Subsequently, at the point that the sampling signal S2 is output, the six data lines 114*a* through 114*f* belonging to the block B2 have the image signals VID1 through VID6 thereof sampled, and the image signals VID1 through VID6 are each written to the six pixels of the scanning line selected by the corresponding TFTs 116 at that point.

In the same way, at the point that the sampling signals S3, S4, and so on through Sm are sequentially output, the six data lines 114*a* through 114*f* belonging to the blocks B3, B4, and so on through Bm have the image signals VID1 through VID6 thereof sampled, and the image signals VID1 through VID6 are each written to the six pixels of the scanning lines currently selected by the corresponding TFTs 116. Then, the next scanning line is selected, and the same writing is executed at the blocks B1 through Bm repeatedly.

With this driving method, the number of tiers of the shift register circuit 140 for performing driving controlling of the switches 131 of the sampling circuit 130 is reduced to ⅙, as compared to the method wherein the data lines are driven according to point sequence. Further, the frequency of the clock signals CLX and the inverted clock signals thereof CLXinv to be supplied to the shift register circuit 140 is also reduced to ⅙, thus reducing electric power consumption along with reducing the number of tiers.

SUMMARY OF THE INVENTION

However, the above-described conventional device suffers from the drawback that when one-system image signals are phase rendered into multiple systems and the liquid crystal display panel is driven using the multiple system image signals, a light image of the same form as the original image is displayed at a position slightly offset from the display position of the original image. This phenomena will be referred to as "ghosting".

There are various causes for ghosting, however, as described below, there are two causes that are uniquely characteristic to phase rendering. A first cause is that the image signal supplying lines L1 through L6 equivalently configure a low-pass filter. In other words, as shown in FIG. 15, the image signal supplying lines L1 through L6 extend in the X direction from the right end of the liquid crystal display panel 100 to the left end thereof, such that a distributed resistance exists there, accompanied by floating capacity. Accordingly, the image signal supplying lines L1 through L6 equivalently make up a low-pass filter. Thus, the waveforms of the image signals VID1 through VID6 input to the switches 131 of the sampling circuit 130 become integrated waveforms. This point is described in greater detail.

FIG. 17 is a timing chart illustrating the waveform of image signals and sampling signals before and following phase rendering. Now, though delay actually occurs along with the phase rendering, the figure ignores the delay time for the sake of clarity. Note that the liquid crystal display panel 100 operates in the normally-white mode.

As shown in graph (a) of FIG. 17, in the event that the image signal VID corresponds to the blocks J−1'th through J+1'th, and is at the intermediate level Vc at the periods t1 through t3, is at the black level Vb at the periods t4 through t14, and is at the intermediate level Vc at the periods t15 through t18, the image signals VID1 through VID6 following rendering will be as shown by graphs (b) through (g) in the figure.

For example, taking note of the image signal VID3 shown in graph (d) in the figure, the image signal VID is at the intermediate level Vc at the period t3, and is at the black level Vb at the period t9, so ignoring the delay time, the image signal VID3 should at the start of the period t7 rapidly rise up from the intermediate level Vc to the black level Vb as shown by the dotted line in the figure. However, as described above, the image signal supplying line L3 equivalently forms a low-pass filter as described above, so the image signal VID3 gradually rises up from the intermediate level Vc, and reaches the black level Vb after a certain amount of time.

Accordingly, assuming that the sampling signal Sj corresponding to the j'th block becomes active in the range from period t7 through period t12 as shown by (h) in the figure, the image signal VID3 supplied to the data line 114*c* of the j'th block is affected by the image signal VID3 to be supplied to the data line 114*c* of the j−1'th block (VID3 in periods t1 through t6). Consequently, taking in the voltage of this data line 114*c* with the TFT 112 making up the pixel causes the voltage value to drop somewhat below the black level, and the pixel becomes somewhat lighter.

Further, assuming that the sampling signal Sj corresponding to the j'th block becomes active in the range from period t7 through period t13 as shown by graph (i) in the figure, the image signal VID3 supplied to the data line 114*c* of the j'th block is affected by not only the image signal VID3 to be supplied to the data line 114*c* of the j−1'th block (image signal VID3 in periods t1 through t6) but also the image signal VID3 to be supplied to the data line 114*c* of the j+1'th block (image signal VID3 in periods t13 through t18).

FIG. 18 is an explanatory diagram illustrating an example of ghosting due to the above-described first cause. In this diagram, the image that should originally be displayed is the arrow P. In relation to this, the arrow P1 and the arrow P2 which are lightly displayed at positions one block before and behind, are ghosts.

Next, the second cause of ghosting is that there is parasitic capacity accompanying each of the data lines 114*a* through 114*f* of each of the blocks B1, B2, and so on through Bm, and that the parasitic capacities are joined. As described above, the data lines 114*a* through 114*f* are formed on the device substrate, and face the facing electrode on the facing substrate across the liquid crystal, and thus parasitic capacity primarily with the opposing electrode occurs. Also, the opposing electrode is grounded with a predetermined impedance. Accordingly, the parasitic capacities of the data lines 114*a* through 114*f* are Ca through Cf, and with the impedance of the opposing electrode as R, the equivalency circuit of the data lines 114*a* through 114*f* is as shown in FIG. 19.

Now, in the event that the image signal VID3 supplied to the data line 114*c* changes from the black level Vb to the intermediate level Vc at upon switching of blocks, the voltage Vx of the shared contact of the parasitic capacities Ca through Cf is the image signal VID3 differentiated, as shown in FIG. 20. This results in the voltage of the data lines 114*a*, 114*b*, and 114*d* through 114*f* changing via the parasitic capacities Ca, Cb, and Cd through Cf.

For example, let us assume an arrangement such as shown in FIG. 21 wherein one screen is configured of blocks B1 through B7, and one vertical black straight line is displayed on an intermediate gradient background. In this case, in the event that the image signal VID3 of the black level Vb is supplied to the data line 114*c* of the block B4, the image signal VID3 changes from the black level Vb to the intermediate level Vc at the point of switching from block B4 to block B5. This causes the voltage of the data lines 114*a*, 114*b*, and 114*d* through 114*f* of block B4 to be affected by the differentiated waveform (see FIG. 20), and rises slightly higher than the voltage corresponding to the intermediate gradient, so the overall block B5 becomes somewhat brighter. Thus, the method of forming blocks of the data lines 114 for driving has had the problem of the quality of the displayed image deteriorating due to the above two types of ghosts.

The present invention has been made in light of these problems, and accordingly it is an object to provide an image processing circuit and image data processing method enabling high-quality display by removing ghosts, an electro-optical device using the same, and an electronic apparatus.

To this end, an image processing circuit according to the present invention comprises a delay circuit for delaying externally supplied image data by a unit time and outputting as first delayed image data, a difference circuit for generating the difference between the first delayed image data and the image data as difference image data, a multiplying circuit for multiplying the difference image data by a coefficient and generating correction data, a generating circuit for synthesizing the image data and the correction data to generate corrected image data, and a phase rendering circuit that divides the corrected image data being input in a time-sequence in to a plurality of phases.

In accordance with the present invention, images are displayed based on image signals divided into multiple systems and extended in the time-axial direction, which maintain a constant signal level each unit time, but floating capacity can exist on the lines for supplying the image signals to the data lines. Accordingly, the waveform of the image signals supplied to the data lines are affected by the floating capacity, and can thus become less sharp. In this case, the image signals in the current unit time are affected by the image signals in the unit time immediately before. According to the present invention, with the image data as the current data, first delayed image data is equivalent to past data by one unit time, and corrected data is generated based on the difference image data thereof. That is to say, the corrected data predicts waveform deterioration of the image signals beforehand. The corrected image data is synthesized based on the correction data and the image data, and accordingly waveform deterioration is generated in the process until image signals supplied to the data lines can be cancelled, by generating image signals based on the corrected image data. Consequently, ghosting due to floating capacity on the lines can be markedly reduced, and the quality of the displayed image can be greatly improved.

Now, the electro-optical device preferably comprises a plurality of switching devices for sampling image signals subjected to phase rendering according to sampling signals and supplying to the data lines, and image signals supplying lines for supplying the image signals to the switching devices, wherein the coefficient is determined according to low-pass filter properties configured equivalently by the image signals supplying lines. Further, the active period of the sampling signals preferably ends within the current unit time of the image signals.

The high-frequency component lost by the image signals being sent over the image signal supplying lines is dependent on the difference level of the image signals in the current and immediately-preceding unit times, and on the properties of the low-pass filter. The data value of the difference image data is equivalent to the difference level, so this multiplied by a coefficient corresponding to the properties of the low pass filter is equivalent to the high-frequency component lost due to the image signal supplying lines. According to the present invention, the coefficient is determined according to the low-pass filter properties, so that correction data, accurately predicting the high-frequency component which will be lost by the image signals being sent over the image signal supplying lines, can be generated.

Next, an image data processing method according to the present invention comprises a step for delaying externally supplied current image data by a unit time and generating past image data; a step for generating correction data based on the difference in data values between the current image data and the past image data; a step for synthesizing the current image data and the correction data to generate corrected image data; and a step for dividing the corrected image data into multiple systems and extending in the time-axial direction, and supplying the image signals maintaining a constant signal level each unit time at a predetermined timing, to a plurality of data lines.

According to the present invention, the correction data can be generated based on the current image data and past image data by one unit time, so that the correction data predicts waveform deterioration of the image signals beforehand. The corrected image data is synthesized based on the correction data and the image data, and accordingly waveform deterioration generated in the process until image signals are supplied to the data lines can be cancelled, by generating image signals based on the corrected image data. Consequently, ghosting due to floating capacity on the lines can be markedly reduced, and the quality of the displayed image can be greatly improved.

Next, an image processing circuit according to the present invention comprises a first delay circuit for delaying externally supplied image data by a unit time of the image signals and outputting as first delayed image data; a second delay circuit for delaying the first delayed image data by a unit time of the image signals and outputting as second delayed image data; a first difference circuit for generating the difference between the first delayed image data and the second delayed image data as first difference image data; a first multiplying circuit for multiplying the first difference image data by a first coefficient and generating first correction data; a second difference circuit for generating the difference between the first delayed image data and the image data as second difference image data; a second multiplying circuit for multiplying the second difference image data by a second coefficient and generating second correction data; a synthesizing circuit for synthesizing the first delayed image data, the first correction data, and the second correction data, to generate corrected image data; and a phase rendering circuit that divides the corrected image data being input in a time-sequence in to a plurality of phases.

According to the present invention, the first delay circuit and the second delay circuit can each delay image data by unit time, so with the first delayed image data as the current data, the image data is equivalent to future data, and the second delayed image data is equivalent to past data. Accordingly, the current data can be corrected based on not only past data, but also future data, thereby generating corrected image data.

Now, the electro-optical device preferably comprises a plurality of switching devices for sampling image signals subjected to phase rendering according to sampling signals and supplying to the data lines, and image signals supplying lines for supplying the image signals to the switching devices, wherein the first coefficient and the second coefficient are determined according to low-pass filter properties configured equivalently by the image signals supplying lines. Further, the active period of the sampling signals preferably starts in the current unit time of the image signals and ends in the next unit time.

The voltage of the data lines is determined at the ending point of the active period of the sampling signals, so in the event that the active period of the sampling signals ends at the next unit time, the voltage of the data line is affected by the image signals of the next unit time. According to the present invention, corrected data is generated by correcting the current data based not only on the past but also on future data, so image signals can be generated based on the corrected image data, and accordingly waveform deterioration generated in the process until image signals are supplied to the data lines can be cancelled by generating image signals based on the corrected image data. Consequently, ghosting due to floating capacity on the lines can be markedly reduced, and the quality of the displayed image can be greatly improved.

Next, an image data processing method according to the present invention comprises a step for taking externally supplied image data as future image data and sequentially delaying this by a unit time so as to generate current image data and past image data; a step for generating first correction data based on difference data value between the current image data and the past image data; a step for generating second correction data based on difference data value between the current image data and the future image data; a step for synthesizing the current image data, the first correction data, and the second correction data, to generate corrected image data; and a step for dividing the corrected image data into multiple systems and extending in the time-axial direction, and supplying the image signals maintaining a constant signal level each unit time at a predetermined timing, to a plurality of data lines.

According to the present invention, the current image data can be corrected based on not only past data but also future data, thereby generating corrected image data.

Next, an image processing circuit according to the present invention comprises a delay circuit for delaying externally supplied image data by a unit time and outputting as delayed image data; a difference circuit for generating the difference between the delayed image data and the image data as difference image data; an averaging circuit for averaging the difference image data each unit time and generating averaged image data; a correcting circuit for correcting the delayed image data based on the averaged image data and generating corrected image data; and a phase rendering circuit that divides the corrected image data being input in a time-sequence in to a plurality of phases.

Parasitic capacity accompanies each of the data lines, and further data lines in close proximity are joined via the parasitic capacity, and the parasitic capacities are grounded via an equivalently shared impedance. Accordingly, in the event that the applied voltage of a particular data line changes, the potential of other data lines changes due to being affected thereby, and ghosts corresponding thereto occur. According to the invention described above, correction data is generated based on the averaged image data obtained by averaging the difference image data by each unit time, so the correction data is of a component corresponding to the above-described ghosts. Accordingly, the corrected image data predicts ghosts beforehand and can cancel the component thereof. Consequently, displaying the image based on corrected image data enables the ghosts to be almost done away with, thereby markedly improving the quality of the displayed image.

Now, the averaging circuit preferably comprises an accumulating adder for accumulating and adding the difference image data each unit time, and a divider for dividing the output data of the accumulating adder by the number of the plurality of systems. Further, the correcting circuit preferably comprises a coefficient unit for multiplying the averaged image data by a coefficient, and an adder for adding the delayed image data and the output data of the coefficient unit.

Next, an image data processing method according to the present invention comprises a step for delaying externally supplied image data by a unit time and generating as delayed image data; a step for generating the difference between the delayed image data and the image data as difference image data; a step for averaging the difference image data each unit time and generating averaged image data; a step for correcting the delayed image data based on the averaged image data and generating corrected image data; and a step for dividing the corrected image data into multiple systems and extending in the time-axial direction, and supplying the image signals maintaining a constant signal level each unit time at a predetermined timing, to a plurality of data lines.

According to the present invention, correction data can be generated predicting beforehand ghost components occurring due to capacity joining of data lines in close proximity. Accordingly, the corrected image data predicts ghosts beforehand and can cancel the component thereof. Consequently, displaying the image based on corrected image data enables the ghosts to be mostly removed, thereby markedly improving the quality of the displayed image.

Next, an electro-optical device according to the present invention comprises an above-described image processing circuit; an image signal generating circuit for generating image signals divided into multiple systems and extended in the time-axial direction and maintaining a constant signal level each unit time, based on the corrected image data; a data line driving circuit for sequentially generating the sampling signals; and a sampling circuit for sampling the image signals based on the sampling signals and supplies to the data lines. According to this electro-optical device, the quality of the displayed image can be greatly improved, and also the time of supplying image signals to the data lines can be extended.

Next, an electronic apparatus according to the present invention comprises an above-described electro-optical device, and is such as a video projector, notebook type personal computer, cellular phone, or the like.

DETAILED DESCRIPTION OF PREFERRED EMBODIMENTS

Figure 1:
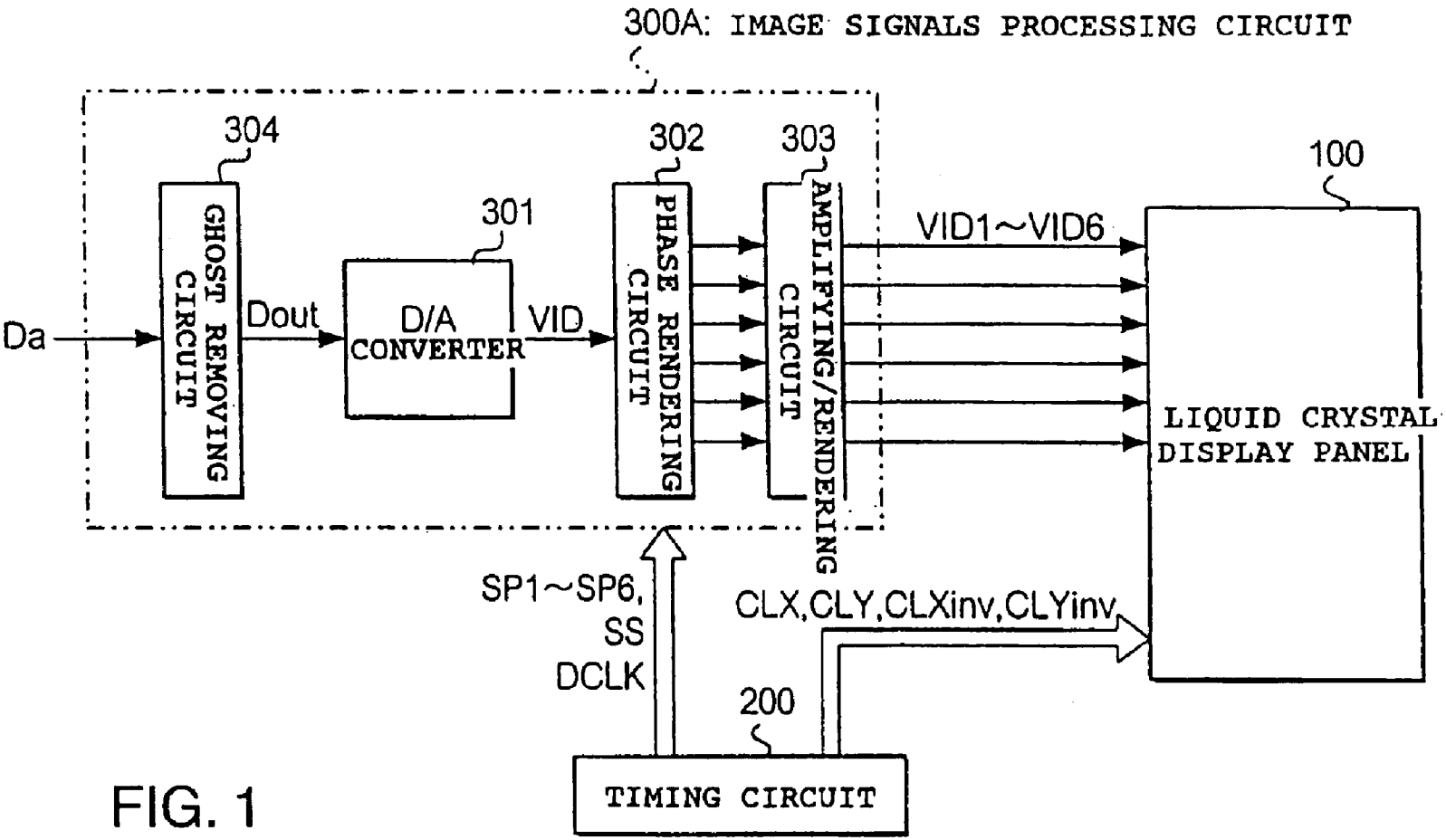
FIG. 1 is a block diagram illustrating the overall configuration of a liquid crystal display device according to a representative first embodiment of the present invention.
Figure 15:
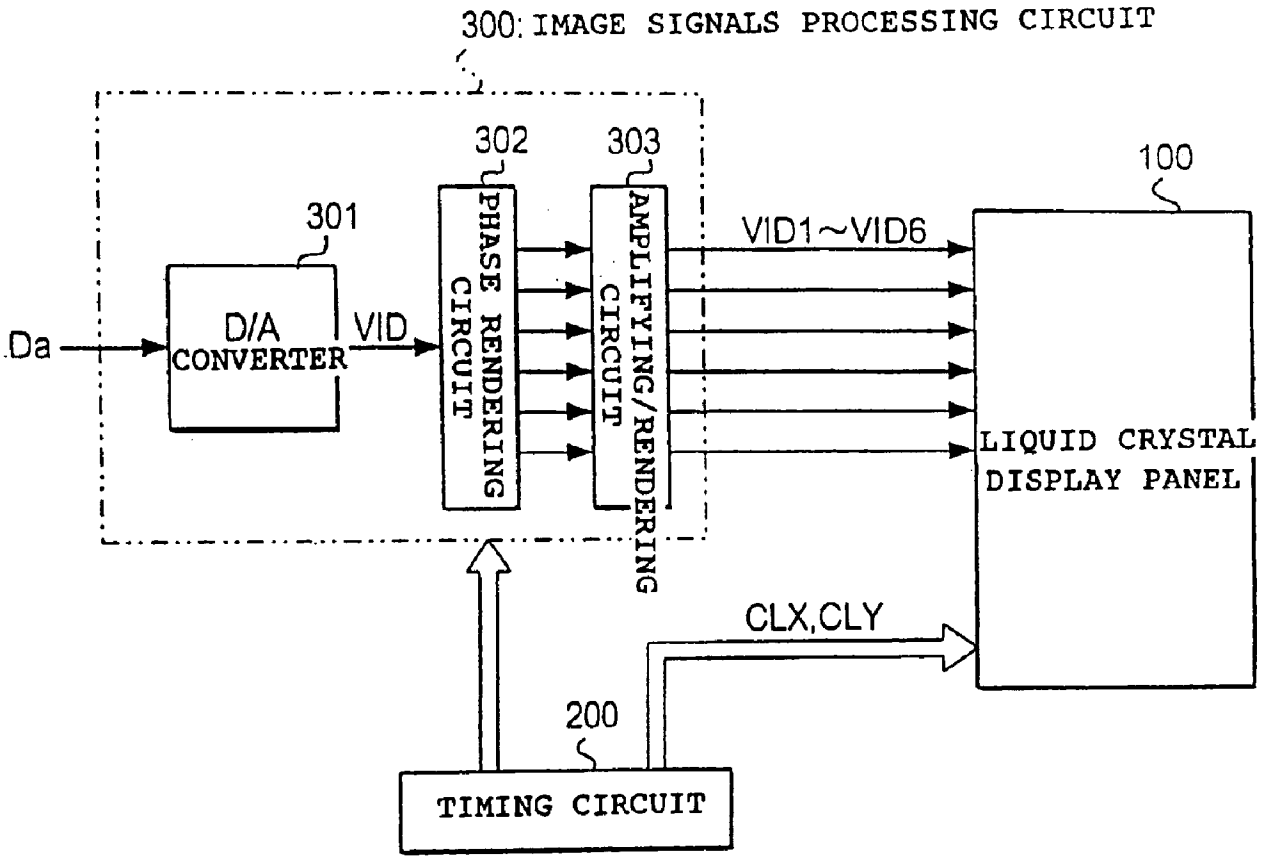
FIG. 15 RELATED ART
FIG. 15 is a block diagram illustrating the overall configuration of a conventional liquid crystal display device.

FIG. 1 is a block diagram illustrating the overall configuration of a liquid crystal display device in accordance with the present invention. The liquid crystal display device according to the present embodiment is configured similar to the conventional liquid crystal display device shown in FIG. 15, with the exception that a ghost removing circuit 304 has been provided in front of the D/A converter 301 in the image signal processing circuit 300A. Incidentally, the image data Da in this example is of a 8-bit parallel format, and is a data string with the cycle of the dot clock signal DCLK as the sampling cycle thereof, supplied from an external device, not shown.

The ghost removing circuit 304 predicts beforehand ghost components due to the above-described first cause, and corrects the image data so as to cancel the negative effects out and generate corrected image data Dout.

The phase rendering circuit 302 subjects image signals VID obtained by performing D/A conversion of corrected image data Dout to serial/parallel conversion, and generates phase rendered image signals VID1 through VID6, rendered in six phases. In more detail, the phase rendering circuit 302 performs sample holding of the image signal VID based on the sample hold pulses SP1 through SP6 and SS every six cycles of the dot clock signal DCLK, thereby extending the time axis of the image signal VID sixfold, and also dividing this into six systems and generating the phase-rendered image signals VID1 through VID6.

The phase-rendered image signals VID1 through VID6 are generated based on the image signal VID, wherein corrected image data synchronized with the dot clock signal DCLK has been subjected to D/A conversion, so that the value of the original corrected image data Dout changes every dot clock cycle, and the phase-rendered image signals VID1 through VID6 change every six dot clock cycles. Accordingly, the phase-rendered image signals VID1 through VID6 are signals which change according to a unit time determined by the product of the number of phase renderings (the number of phases to be divided into) and one cycle of the dot clock signal DCLK.

Figure 16:
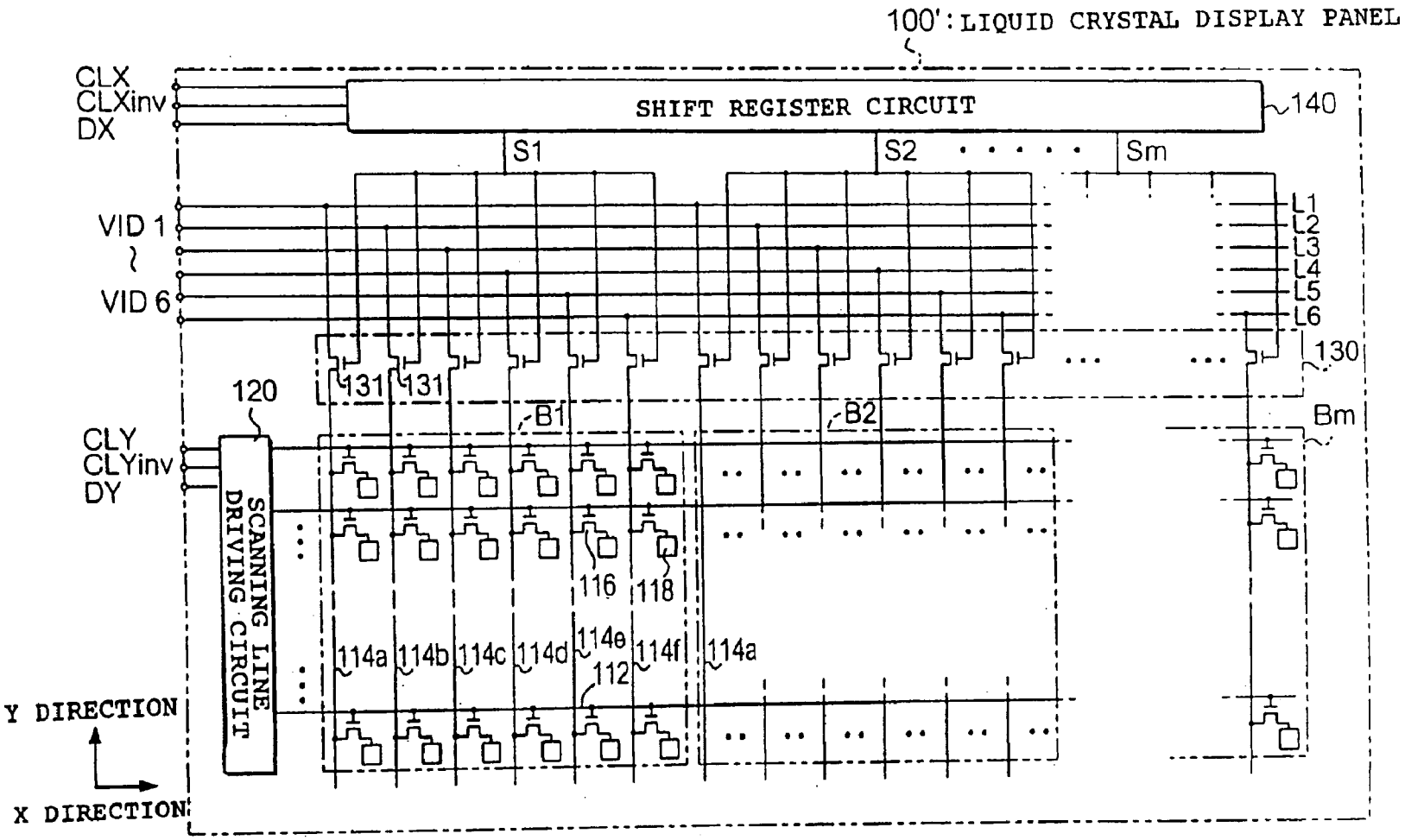
FIG. 16 RELATED ART
FIG. 16 is a block diagram illustrating the electrical configuration of the liquid crystal panel in the conventional liquid crystal display device.
Figure 17:
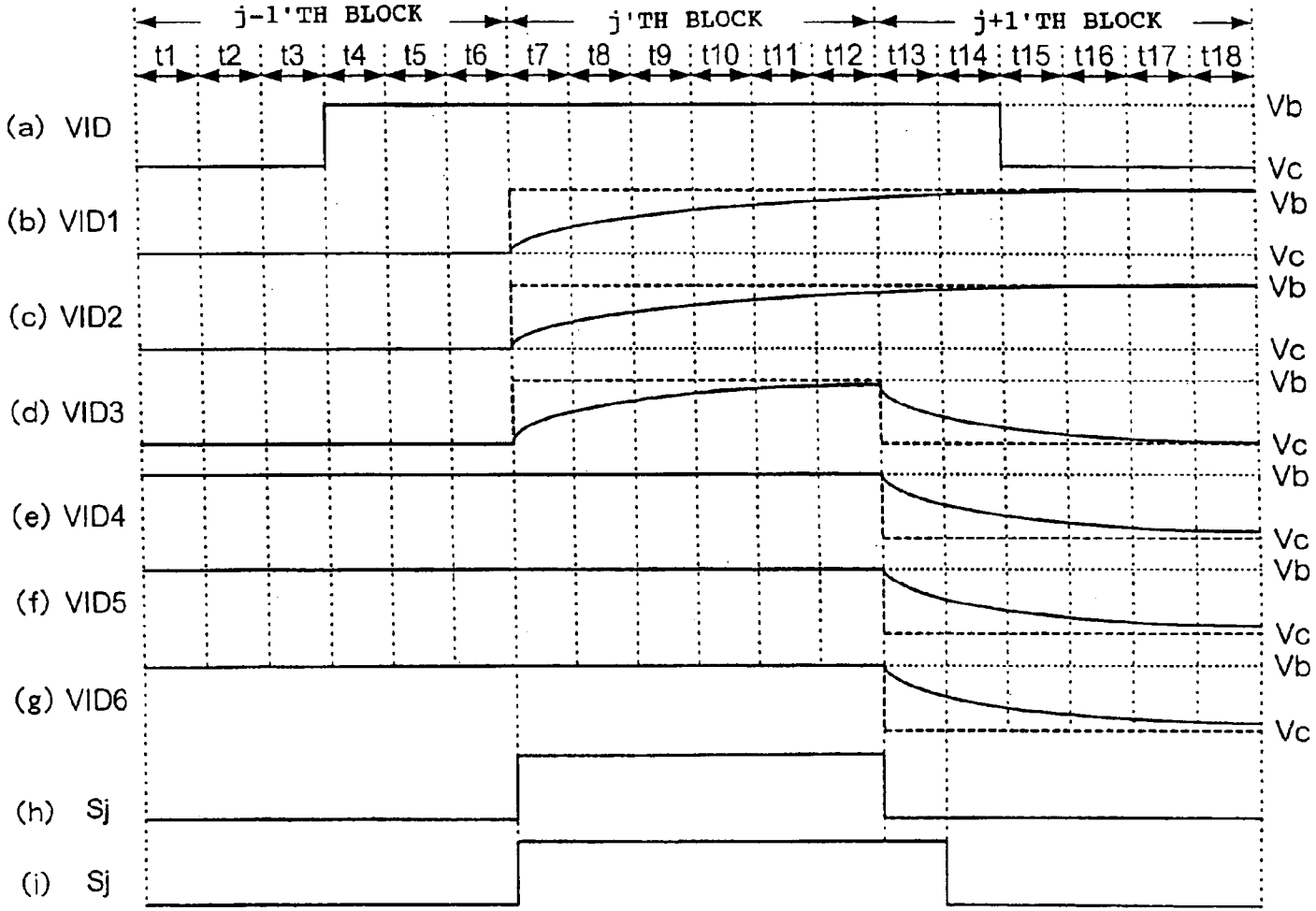
FIG. 17 is a timing chart illustrating the action of a conventional liquid crystal display device.
Figure 18:
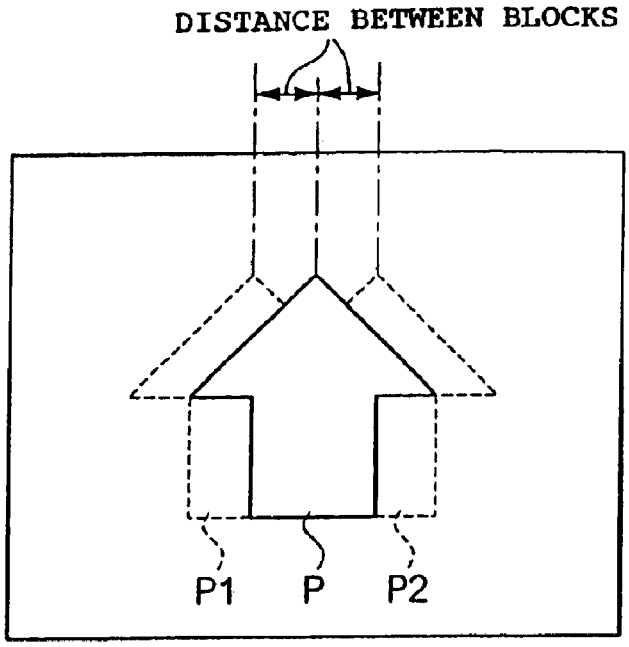
FIG. 18 is an explanatory diagram illustrating an example of ghosts.
Figure 19:
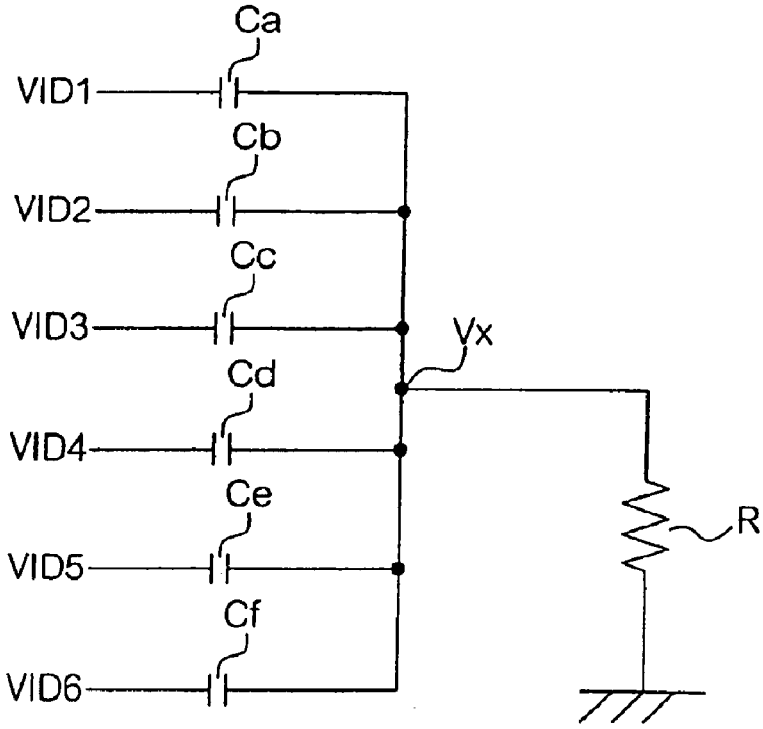
FIG. 19 is a circuit diagram illustrating an equivalent circuit of the data lines in a particular block.
Figure 20:
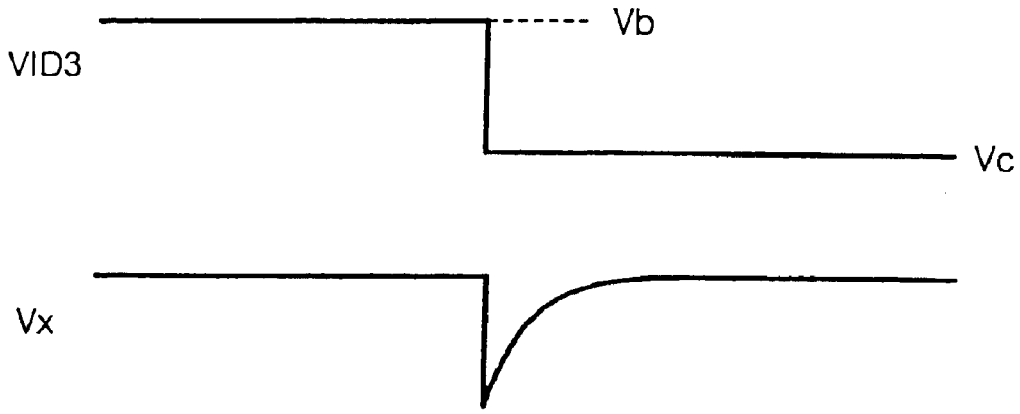
FIG. 20 is a waveform diagram illustrating the relation between image signals and the voltage of the shared contact point of each parasitic capacity.
Figure 21:
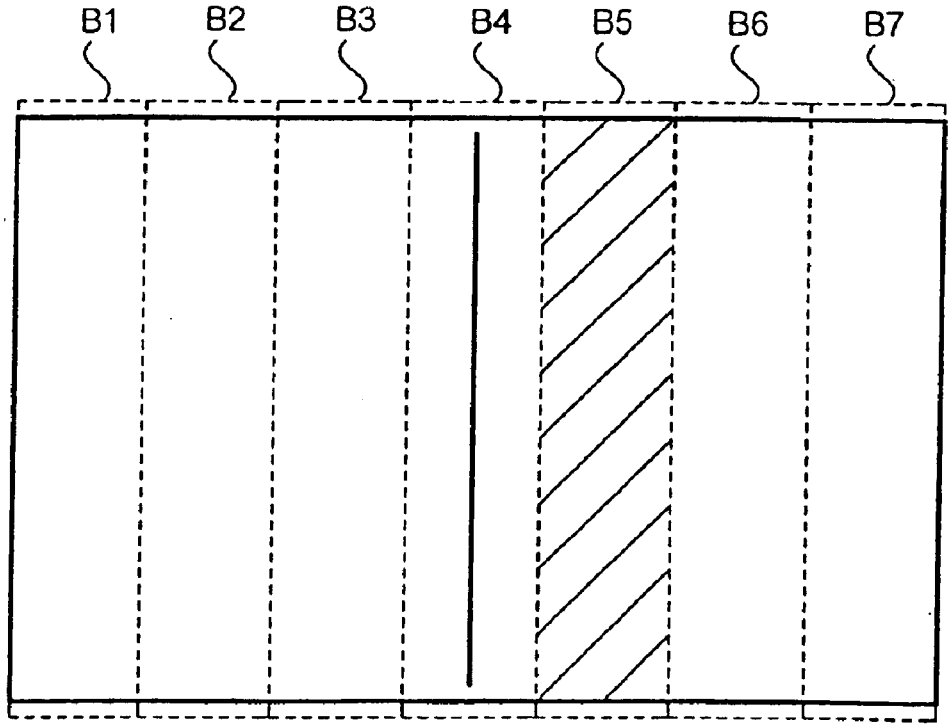
FIG. 21 is an explanatory diagram illustrating an example of ghosts.

The liquid crystal display panel 100 is similar to the conventional liquid crystal display device shown in FIG. 16.

Figure 2:
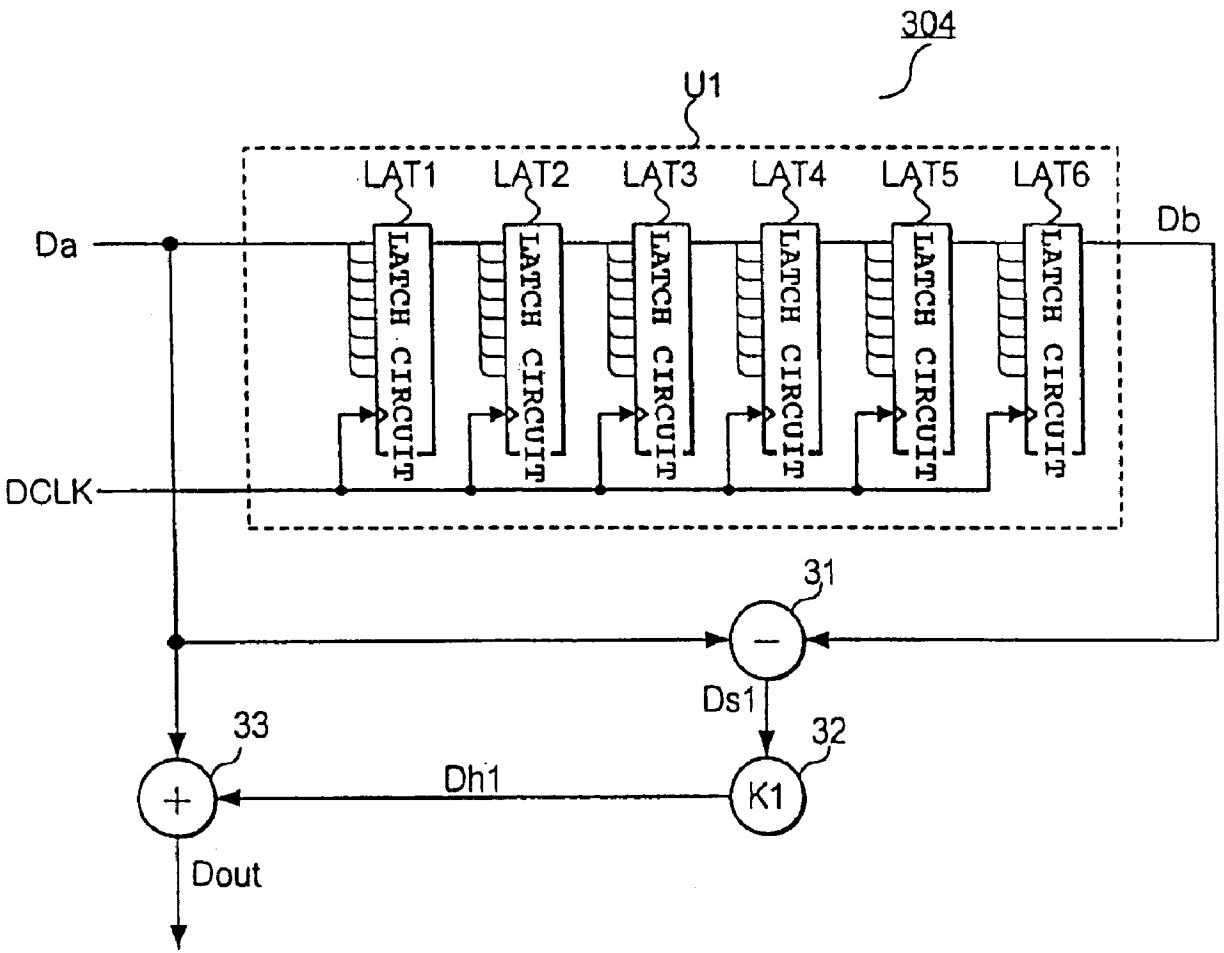
FIG. 2 is a block diagram illustrating an exemplary configuration of a ghost removing circuit in the liquid crystal display device.

FIG. 2 is a circuit diagram of the ghost removing circuit 304. As shown in the figure, the ghost removing circuit 304 is made up of a first delay unit U1, a first difference computing circuit 31, a first coefficient circuit 32, and an adding circuit 33. The ghost removing circuit 304 is used for predicting the ghost components occurring due to the image signal supplying lines L1 through L6 equivalently configuring a low-pass filter, and correcting the image data Da so as to cancel the effects thereof.

First, the first delay unit U1 is configured with six latch circuits LAT1 through LAT6 serially connected, and outputs image data Db which is the image data Da delayed by a predetermined amount of time. Now, the latch circuits LAT1 through LAT6 are arranged so as to latch 8-bit input data based on the dot clock signals DCLK.

The dot clock signal DCLK is the master clock for the liquid crystal display device, and is generated at the timing circuit 200. Also, the timing circuit 200 is arranged so as to divide dot clock signals DCLK and generate clock signals CLX for driving the data line driving circuit of the liquid crystal display panel 100 and clock signals CLY for driving the scanning line driving circuit. In this example, six-phase phase rendering is performed in the phase rendering circuit 302. Accordingly, the clock signal CLX is generated by dividing the dot clock signal DCLK into six equal parts.

The first delay unit U1 has six latch circuits LAT1 through LAT6 that are driven by the dot clock signals DCLK serially connected, so that the image data Db is data delayed as compared to the image data Da by six dot cycles.

Now, as described above, the phase-rendered image signals VID1 through VID6 are signals which change according to a unit time determined by the product of the number of phase renderings (the number of phases to divide the image signals VID into) and one cycle of the dot clock signal DCLK. In this example, one unit time is six dot cycles, which matches the delay time of the first delay unit U1. In other words, the first delay unit U1 delays the image data Da by an amount of time equivalent to the unit time of the phase-rendered image signals VID1 through VID6 obtained by phase rendering (serial/parallel conversion), thereby obtaining the image data Db. Now, considering that the image data Da is current data, this means that the image data Db is past data by one unit time.

Next, the first difference computing circuit 31 calculates the difference between the image data Da and the image data Db. Specifically, the image data Db (past) is subtracted from the image data Da (present) to generate first difference data Ds1. Also, the first coefficient circuit 32 is configured as a multiplier, for multiplying the first difference data Ds1 by a coefficient K1 and outputting the multiplied results as first correction data Dh1.

Next, the adding circuit 33 adds the first correction data Dh1 and the image data Da, and outputs the added results as corrected image data Dout.

The signal level of the phase-rendered image signals VID1 through VID6 switches every unit time and is a constant level, so in the event that there is change in the signal level, the signal waveform at the input of the image signal supplying lines L1 through L6 changes rapidly. On the other hand, the image signal supplying lines L1 through L6 equivalently form a low-pass filter, so the signal waveforms of the phase-rendered image signals VID1 through VID6 supplied to the switches of the sampling circuit are integrated. In other words, in the event that transition is made from the immediately-preceding unit time to the current unit time, the signal waveform gradually changes from the level of the immediately-preceding unit time to the level of the current unit time. Accordingly, the signal level of the phase-rendered image signals in the current unit time are affected by the signals of the immediately-preceding unit time. The degree thereof depends on the signal level in the current unit time and the signal level in the immediately-preceding unit time, and the properties of the low-pass filter.

On the other hand, the image data Db is past data by one unit time with respect to the image data Da, so saying that the image data Da corresponds to the phase-rendered image signals of the current unit time, the image data Db corresponds to the phase-rendered image signals of the immediately-preceding unit time. Accordingly, the first difference data Ds1 corresponds to the difference level between the signal level of the current unit time and the signal level of the immediately preceding unit time. Now, the above-described coefficient K1 is predetermined according to the properties of the low-pass filter. Accordingly, the first correction data Dh1 is equivalent to the waveform component lost by integration at the low-pass filter of the image signal supplying lines L1 through L6. In other words, the waveform component lost in the process of being sent through the image signal supplying lines L1 through L6 is predicted beforehand, thereby generating the first correction data Dh1.

The corrected image data Dout is generated by synthesizing the first correction data Dh1 and the image data Da, so the corrected image data Dout has the waveform components which will be lost by integration accented beforehand. Supplying the phase-rendered image signals VID1 through VID6 generated by subjecting the corrected image data Dout to phase rendering processing to the switches of the sampling circuit via the image signal supplying lines L1 through L6 results in the signal waveform being integrated and thus being less sharp. However, the phase-rendered image signals VID1 through VID6 have been accented by the first correction data Dh1, which cancels the effects of the signal level in the immediately-preceding unit time, and the unaffected phase-rendered image signals VID1 through VID6 are supplied to the data lines 114 via the sampling circuit. Accordingly, ghosts occurring due to the image signal supplying lines L1 through L6 forming a low-pass filter can be removed.

Figure 3:
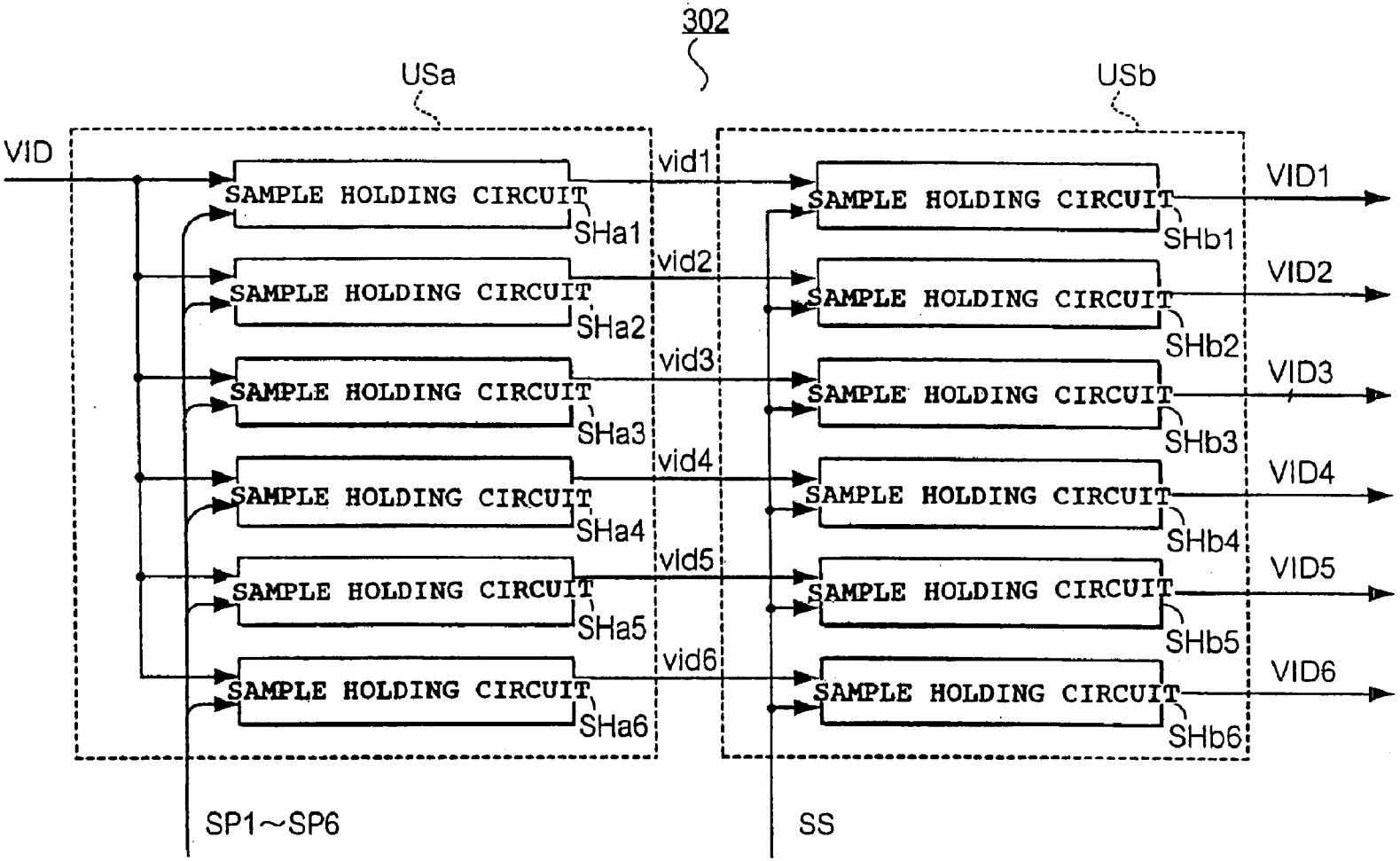
FIG. 3 is a block diagram illustrating an exemplary configuration of a phase rendering circuit in the liquid crystal display device.

FIG. 3 is a block diagram illustrating the primary configuration of the phase rendering circuit 302. As shown in the Figure, the phase rendering circuit 302 has a first sample hold unit USa comprising sample hold circuits SHa1 through SHa6, and a second sample hold unit USb comprising sample hold circuits SHb1 through SHb6.

First, the sample hold circuits SHa1 through SHa6 of the first sample hold unit USa are arranged so as to generate signals vid1 through vid6 by performing sample holding of the image signal VID, based on the sample hold pulses SP1 through SP6 supplied from the timing circuit 200. Here, one cycle of the sample hold pulses SP1 through SP6 is equivalent to six times the dot clock signal DCLK, and the phase of the pulses is one dot clock signal DCLK cycle off one from another. Accordingly, the signals vid1 through vid6 are signals extended sixfold in time axis as to the image signal VID, and also sequentially phase-shifted by the dot clock signal cycle.

Next, the sample hold circuits SHb1 through SHb6 of the second sample hold unit USb are arranged so as to perform sample holding of the signals vid1 through vid6, based on the sample hold pulse SS supplied from the timing circuit 200, and output the results thereof as phase-rendered image signals VID1 through VID6 via an unshown buffer. The sample hold pulse SS is a one unit time cycle pulse. Accordingly, the phases of the signals vid1 through vid6 are matched at the timing that the sample hold pulse SS becomes active, thereby generating phase-rendered image signals VID1 through VID6 with matched phases.

Figure 4:
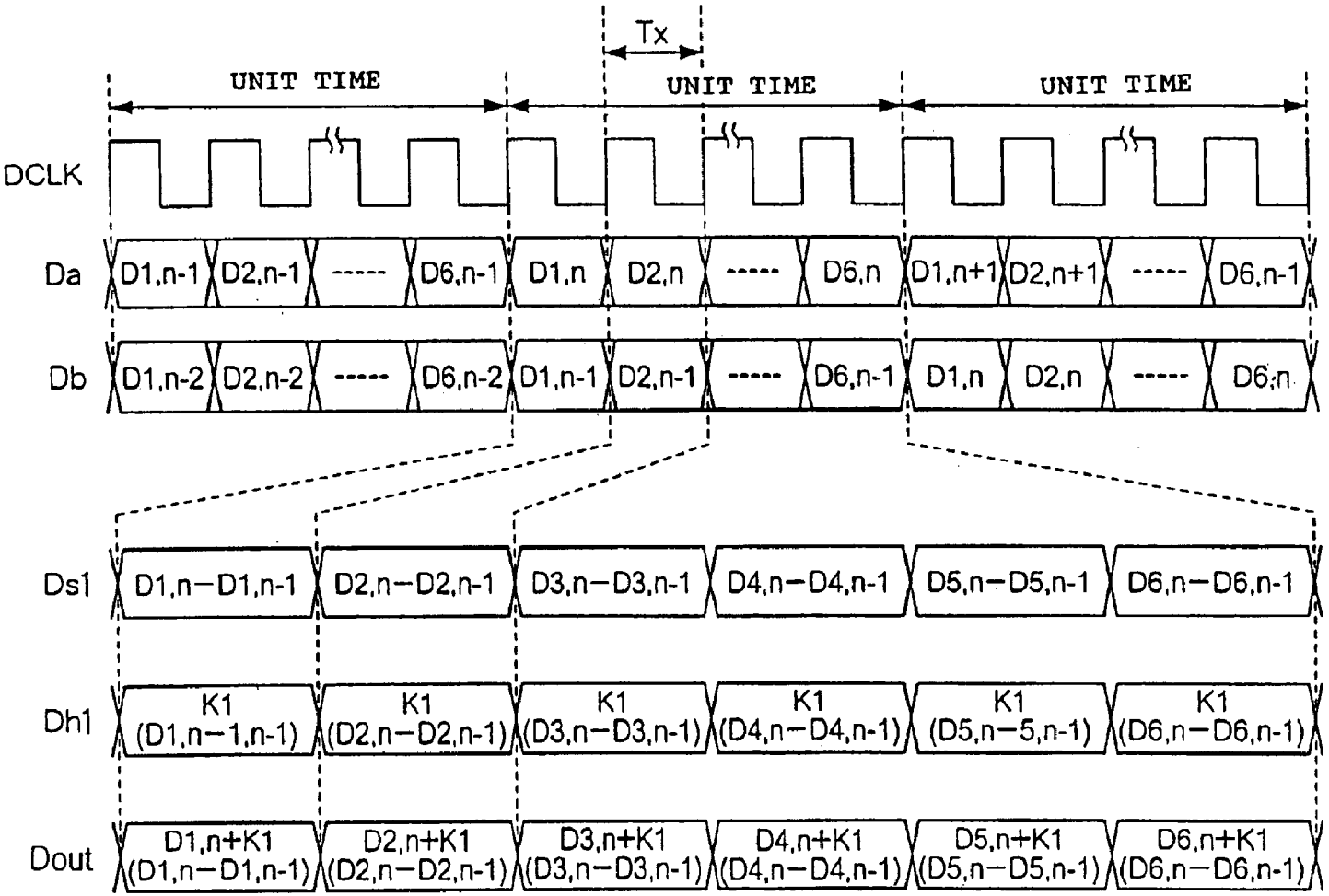
FIG. 4 is a timing chart illustrating an exemplary operation of the ghost removing circuit.

Next, an exemplary operation of the liquid crystal display device will be described in order. First, the operation from the image data Da being input up to the corrected image data Dout being generated by the ghost removing circuit 304 will be described. FIG. 4 is a timing chart for describing the operation of the ghost removing circuit 304. Incidentally, with regard to expressions DX, Y, in this figure, the appended symbol X represents which number a data line 114 is, counted in order in the scanning direction of the block, within a particular block, and on the other hand, the appended symbol Y represents which number the block is. For example, D1, n+1 represent corresponding to the number 1 data line 114*a* in the block, and the block is the n+1'th block.

First, once the image data Da is supplied to the ghost removing circuit 304, the first delay unit U1 delays the image data Da by one unit time (six dot cycles) and outputs this as image data Db. Thus, image data Db for one unit time earlier as compared to the image data Da, is obtained.

For example, looking at period Tx shown in FIG. 4, the image data Da is D2, n, corresponding to data line 114*b* of block Bn. On the other hand, the image data Db is D2, n−1, corresponding to data line 114*b* of block Bn−1. The image signals VID2 are supplied to the data lines 114*b* of each block via the image signals supplying line L2. That is, the image data Da and the image data Db both correspond to the image signals VID2 supplied via the image signals supplying line L2. Also, the image data Da and the image data Db correspond to the adjacent block, and thus is data equivalent to before and after the level of the image signal VID2 switches.

Subsequently, the first difference computing circuit 31 subtracts the second image data Db from the first image data Da and generates first difference data Ds1, whereupon the first coefficient circuit 32 multiplies the first difference data Ds1 by the coefficient K1 and generates first correction data Dh1. Accordingly, in the period Tx, the first difference data Ds1 is "D2, 2-D2, n−1", and the first correction data Dh1 is "K1 (D2, 2−D2, n−1)". Further, the corrected image data Dout is the added sum of the first correction data Dh1 and the image data Da, and thus is "D2, n+K1 (D2, 2−D2, n−1)". The corrected image data Dout thus obtained is converted into analog signals via the A/D converter 301 and is supplied to the phase rendering circuit 302 as image signals VID.

Figure 5:
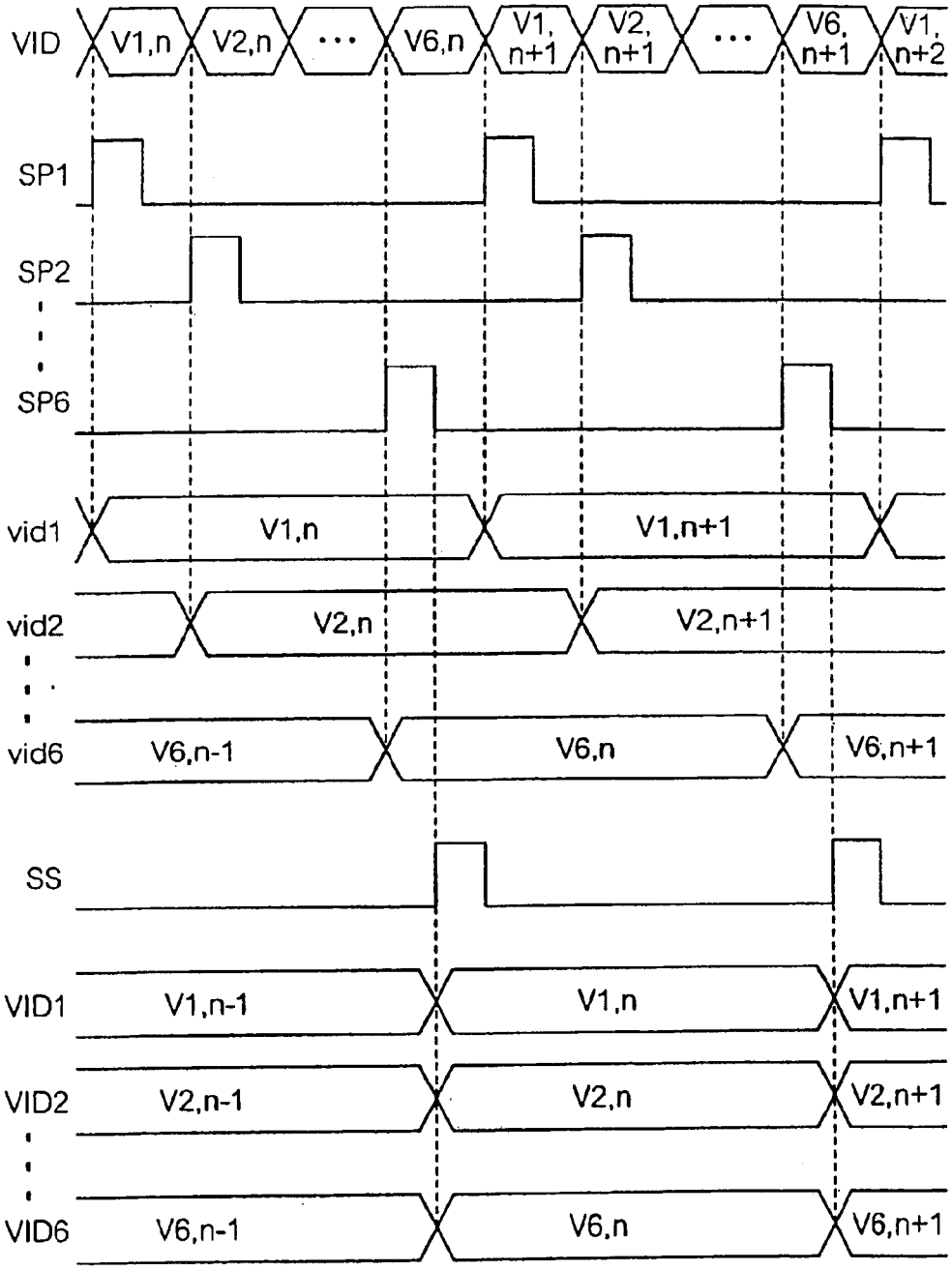
FIG. 5 is a timing chart illustrating the action of the phase rendering circuit in the liquid crystal display device.

Next, the operation up to the phase-rendered image signals VID1 through VID6 being generated based in the image signal VID, will be described. FIG. 5 is a timing chart illustrating an exemplary operation of the phase rendering circuit. Once the image signals VID are supplied to the phase rendering circuit 302, the sample hold circuits SHa1 through SHa6 synchronously with the sample hold pulses SP1 through SP6 extend the time axis of the image signal VID sixfold and also divides this into six systems, thereby generating the phase-rendered image signals VID1 through VID6 shown in the figure. Further, the sample hold circuits SHa1 through SHa6 synchronously with the sample hold pulse SS perform sample holding of the signals vid1 through vid6, thereby generating image signals VID1 through VID6.

Figure 6:
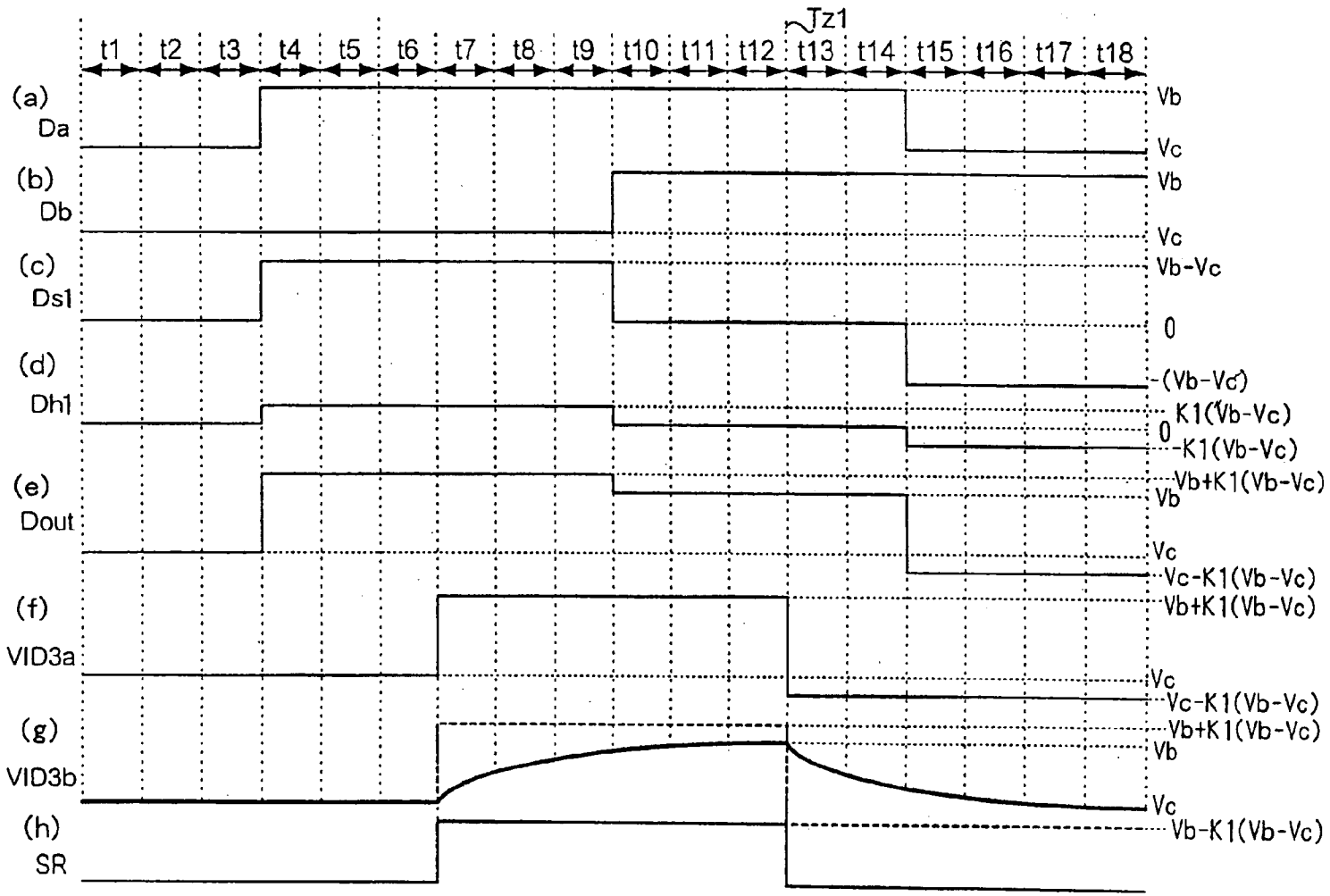
FIG. 6 is a timing chart illustrating the operation, from image data Da being supplied in the ghost removing circuit, until the phase-rendered image signals VID3 being supplied to the data lines.

Now, the operation of ghosts being cancelled will be described in greater detail. FIG. 6 is a timing chart illustrating the operation from the image data Da being supplied up to the phase-rendered image signal VID3 being supplied to the data line 114*c*. Incidentally, in FIG. 6 the data values have been converted into analog signal level representations, and the delay time due to the phase rendering is ignored for the sake of clarity. Also, in this example, the image data Da has data values corresponding to the intermediate level Vc in periods t1 through t3, the black level Vb in periods t4 through t14, and the intermediate level Vc in periods t15 through t18.

The image data Da shown in FIG. 6(*a*) rises to the black level Vb from the intermediate level Vc at the starting point of the period t4, but becomes image data Db after a delay of six dot clock cycles, and accordingly as shown in graph (b) of the figure, the image data Db rises from the black level Vb from the intermediate level Vc at the starting point of the period t10.

As shown in graph (c) of FIG. 6, the first difference data Ds1 is "0" in periods t1 through t3, is "Vb−Vc" in periods t4 through t14, and is "−(Vb−Vc)" in periods t15 through t18. Further, the first correction data Dh1 is the first difference data Ds1 multiplied by the coefficient K1, and accordingly the data value thereof changes as shown in (d) of the figure. Moreover, the corrected image data Dout is generated by adding the image data Da to the first correction data Dh1, so as shown in (e) of the figure, the data value thereof is "Vc" in periods t1 through t3, is "Vb+K1(Vb−Vc)" in periods t4 through t9, is "Vb" in periods t10 through t14, and is "Vc−K1(Vb−Vc)" in periods t15 through t18.

Next, the phase-rendered image signal VID3 is a signal obtained by performing sample holding of the corrected image data Dout in the periods t3, t9, and t15, so ignoring the delay time necessary for phase rendering, the phase-rendered image signal VID3*a* shown in graph (f) of FIG. 6 is obtained. It is of interest to note that "VID3*a*" indicates the phase-rendered image signal input to the image signal supplying line L3, and "VID3*b*" indicates the phase-rendered image signal supplied to the data line 114*c* via the sampling circuit.

As shown in the figure, the phase-rendered image signal VID3*a* in periods t7 through t12 corresponds to the image data in period t9, but the signal level is greater than the data value of the image data Da by "K1(Vb−Vc)". Also, the phase-rendered image signal VID3*c* in periods t13 through t18 corresponds to the image data in period t15, but the signal level is smaller than the data value of the image data Da by "K1(Vb−Vc)".

Once the phase-rendered image signal VID3*a* is sent to the switch of the sampling circuit via the image signal supplying line L3, the high-frequency component is lost in the process, so that the signal waveform of the phase-rendered image signal VID3*b* has a less sharper rising waveform and falling waveform, as shown in graph (g) of the figure.

Now, saying that a sampling signal SR indicated in graph (h) in the figure has been supplied to the gate electrode of the TFT making up this switch, the switch is on in periods t7 through t12, the phase-rendered image signal VID3*b* is supplied to the data line 114*c*, and the switch goes off at the ending time Tz1 of the period t12. Accordingly, the application voltage on the data line 114*c* is determined by the signal level of the phase-rendered image signal VID3*b* at time Tz1.

In this example, the signal level of the phase-rendered image signal VID3*a* in the periods t7 through t12 is "Vb+K1(Vb−Vc)", so that even in the event that the waveform of the phase-rendered image signal VID3*b* rises slowly, the level of the phase-rendered image signal VID3*b* at the time Tz1 is "Vb". In other words, at the ending time Tz1 of the active period of the sampling signal SR, the value of the coefficient K1 is determined so that the voltage originally intended for application can be obtained. Also, with this example, an example has been described wherein the active period of the sampling signal SR starts from the start of period t7 and ends at the end of period t12, but the ending time Tz1 may be at any point within the range of the periods t7 through t12, and the coefficient K1 can be determined according to the relative phase relation between the active period of the sampling signal SR and the phase-rendered image signals VID1 through VID6.

Thus, according to the present embodiment, ghost components are predicted based on image data corresponding to the blocks before and after, and the image data corresponding to the block is corrected, so ghosts can be cancelled, thereby greatly improving the image quality of the display image.

With the above-described liquid crystal display device according to the first embodiment, before phase rendering in the ghost removing circuit 304, waveform deterioration due to the image signal supplying lines L1 through L6 is predicted based on the image data Db from one unit time back (past) and the current image data Da, and the image data Da is corrected so that the original signal level can be obtained at the ending time Tz1 of the active period of the sampling signal SR, thereby generating the corrected image data Dout. However, depending on the generating method of the sampling signal SR, there are cases wherein the ending time Tz1 goes past the current unit time and occurs in the next unit time. In such cases, the applied voltage of the data lines 114 is affected by future image data values. The second embodiment provides a liquid crystal display device whereby the ghost components can be predicted in such cases as well, and can be cancelled.

The liquid crystal display device according to the second embodiment is similar to the liquid crystal display device according to the first embodiment shown in FIG. 1, except that a ghost removing circuit 305 is used instead of the ghost removing circuit 304, and that the active period of the sampling signal SR is contained not only in the current unit time but also in the next unit time.

Figure 7:
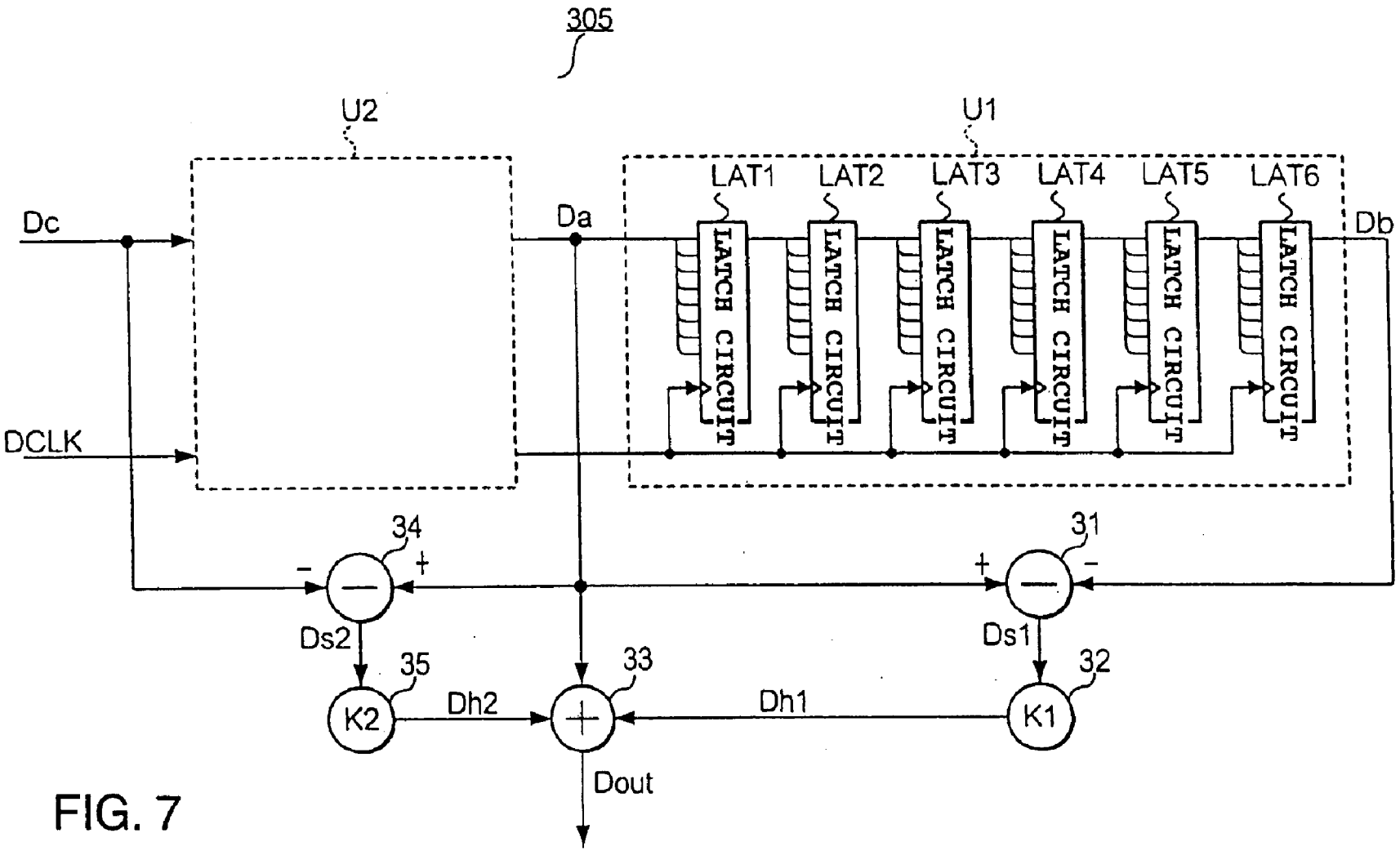
FIG. 7 is a block diagram illustrating the primary configuration of a ghost removing circuit used in a liquid crystal display device according to a representative second embodiment of the present invention.

FIG. 7 is a circuit diagram of the ghost removing circuit 305. The ghost removing circuit 305 is made up of a second delay unit U2, a second difference computing circuit 34, and a second coefficient circuit 35, in front of the ghost removing circuit 304.

First, the second delay unit U2 is configured with six latch circuits LAT1 through LAT6 serially connected, as with the first delay unit U1, and outputs image data Da which is the image data Dc delayed by a unit time (six dot clock cycles). Now, saying that the image data Da is the present, the image data Dc is equivalent to data one unit time later, i.e., future data.

Next, the second difference computing circuit 34 has a subtracter, and subtracts the image data Db from the image data Da to generate second difference data Ds2. Further, the second coefficient circuit 35 has a multiplier, and multiplies the second coefficient K2 and second difference data Ds2 so as to obtain second correction data Dh2. Moreover, the adding circuit 33 adds the image data Da, the first correction data Dh1, and the second correction data Dh2, to generate corrected image data Dout. According to this ghost removing circuit 305, current image data Da can be corrected using not only past image data Db, but also future image data Dc.

Figure 8:
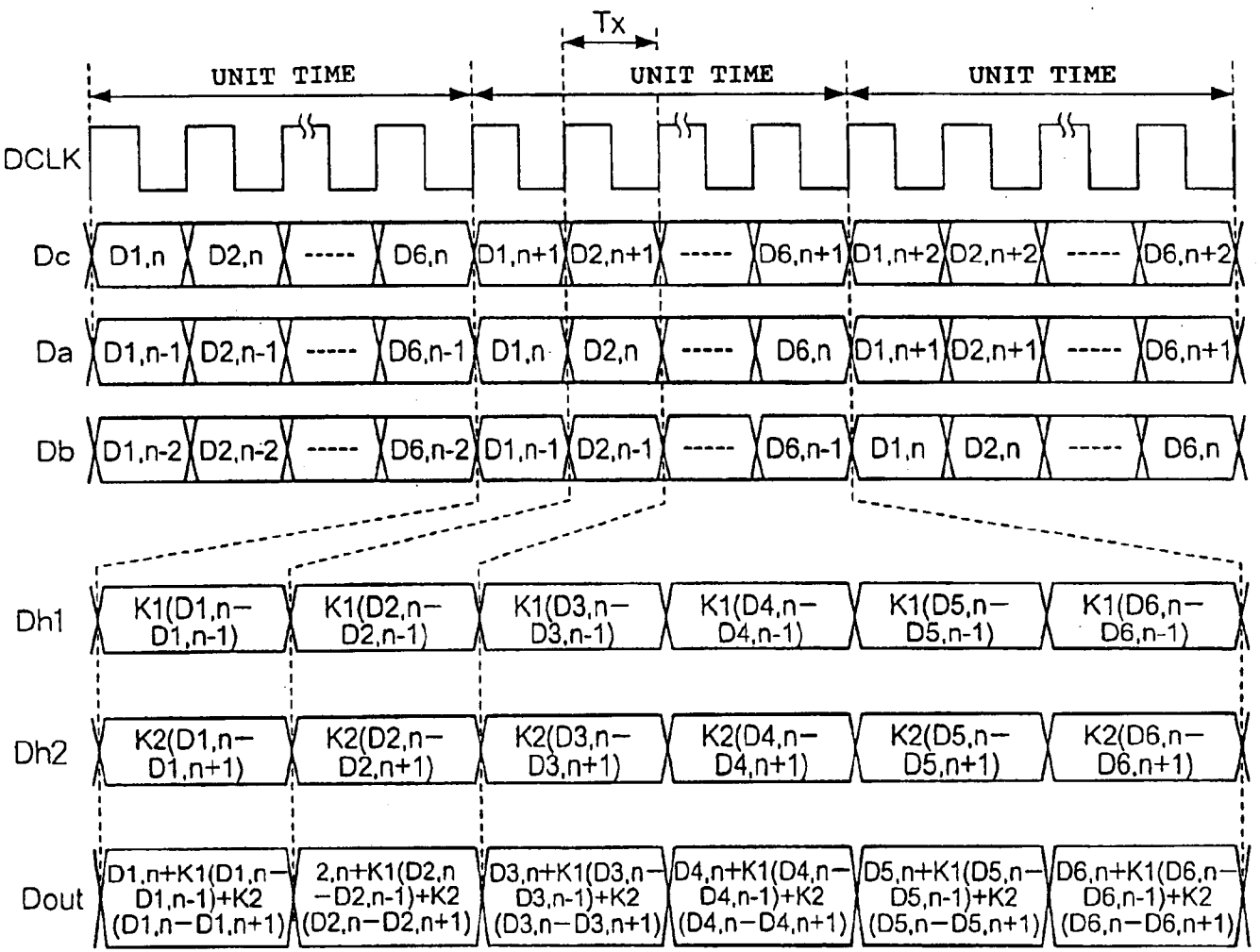
FIG. 8 is a timing chart illustrating an exemplary operation of the ghost removing circuit.

Next, an exemplary operation of the liquid crystal display device will be described in order. First, the operation from the image data Dc being input, up to the corrected image data Dout being generated by the ghost removing circuit 305, will be described. FIG. 8 is a timing chart for describing the operation of the ghost removing circuit 305.

First, once the image data Dc is supplied to the ghost removing circuit 305, image data Dc is delayed by one unit time (six dot cycles) each by the second delay unit U2 and the first delay unit U1 and is output as image data Da and Db.

Thus, image data Db and Dc which are one unit time before and after the image data Da, are obtained. For example, looking at period Tx shown in FIG. 8, the image data Da is "D2, n", corresponding to data line 114*b* of block Bn. On the other hand, the image data Dc is "D2, n+1", corresponding to data line 114*b* of block Bn+1.

Subsequently, the second difference computing circuit 34 subtracts the image data Dc from the image data Da and generates second difference data Ds2, whereupon the second coefficient circuit 32 multiplies the second difference data Ds2 by the second coefficient K2 and generates second correction data Dh2. Accordingly, in the period Tx, the second correction data Dh2 is "K2(D2, n−D2, n+1)". On the other hand, the first correction data Dh1 is "K1(D2, n−D2, n−1)", as described in the first embodiment.

Further, the corrected image data Dout is the added sum of the first correction data Dh1, the second correction data Dh2, and the image data, and thus is "D2, n+K1(D2, n−D2, n−1)+K2(D2, n−D2, n+1)". Also, the operation of subjecting the corrected image data Dout to A/D conversion and phase-rendering the obtained image signals VID is similar to that of the first embodiment shown in FIG. 5, so description thereof is omitted here.

Figure 9:
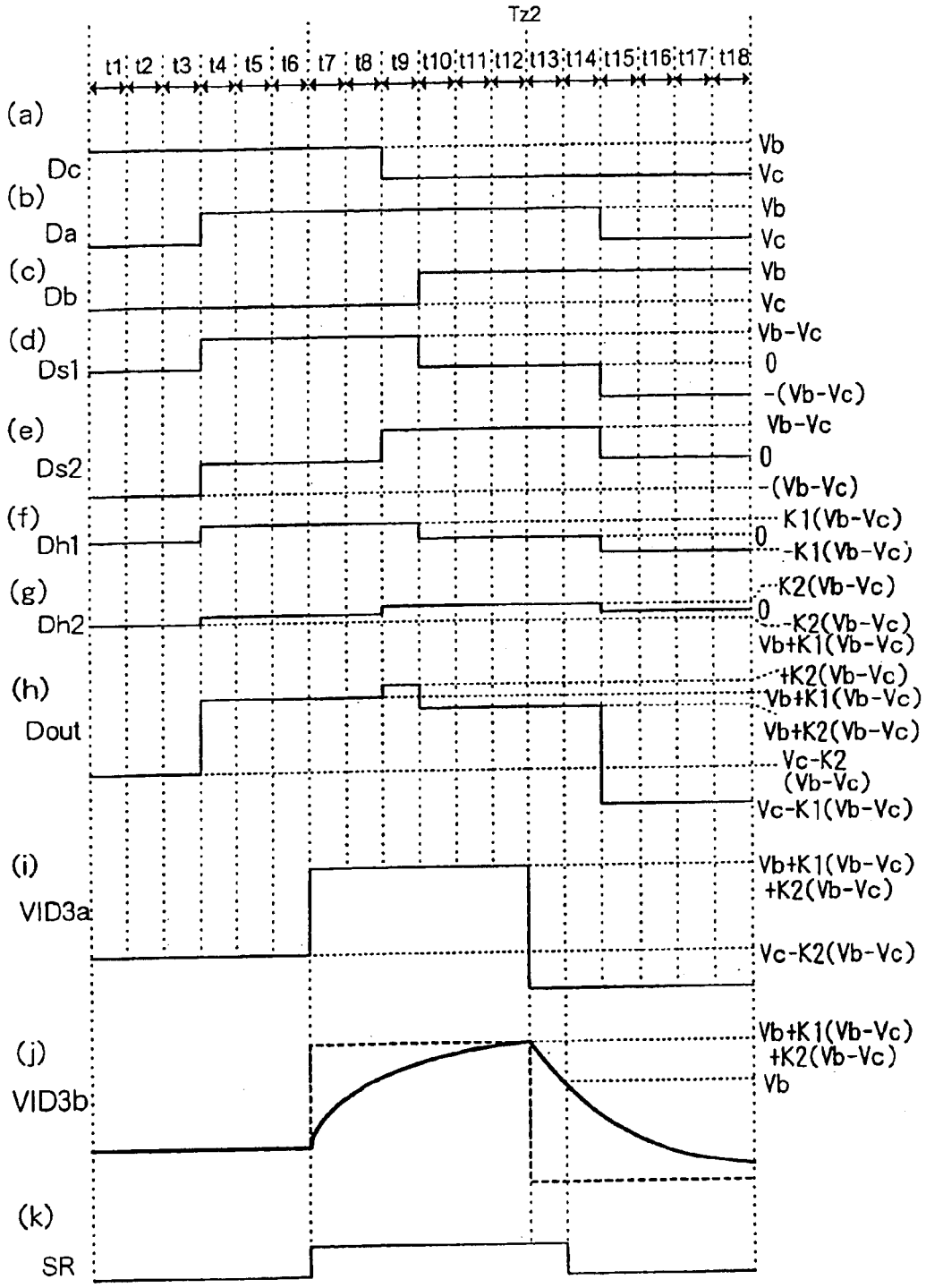
FIG. 9 is a timing chart illustrating the operation, from image data Da being supplied in the ghost removing circuit, until the phase-rendered image signals VID3 being supplied to the data lines.

Now, the operation of ghosts being cancelled will be described in detail. FIG. 9 is a timing chart illustrating the operation from the image data Dc being supplied up to the phase-rendered image signal VID3 being output to the data line 114*c*.

The image data Dc shown in FIG. 9(*a*) is delayed by six dot clock cycles (one unit time) and becomes image data Da shown in (b) in the figure, and further is delayed by six dot clock cycles and becomes image data Db shown in (c) in the figure.

Now, the second difference data Ds2 is obtained by subtracting the image data Dc from the image data Da, and accordingly is "−(Vb−Vc)" in periods t1 through t3, is "0" in periods t4 through t8, is "Vb−Vc" in periods t9 through t14, and is "0" in periods t15 through t18. Further, the second correction data Dh2 is the second difference data Ds2 multiplied by the coefficient K2, and accordingly the data value thereof changes as shown in graph (g) of the figure. The first difference data Ds1 and first correction data Dh1 respectively shown in (d) and (f) of the figure are similar to the first embodiment, and accordingly should need further explanation.

Moreover, the corrected image data Dout is generated by adding the image data Da to the first correction data Dh1 and the second correction data Dh2, so as shown in graph (h) of FIG. 9, the data value thereof is "Vc−K2(Vb−Vc)" in periods t1 through t3, is "Vb+K1(Vb−Vc)" in periods t4 through t8, is "Vb+K1(Vb−Vc)+K2(Vb−Vc)" in period t9, is "Vb+K2(Vb−Vc)" in periods t10 through t14, and is "Vc−K1(Vb−Vc)" in periods t15 through t18.

Next, the phase-rendered image signal VID3 is a signal obtained by performing sample holding of the corrected image data Dout in the periods t3, t9, and t15, so ignoring the delay time necessary for phase rendering, the phase-rendered image signal VID3*a* shown in graph (i) of the figure is obtained.

Once the phase-rendered image signal VID3*a* is sent to the switch of the sampling circuit via the image signal supplying line L3, the high-frequency component is lost in the process, so the signal waveform of the phase-rendered image signal VID3*b* is a less sharper rising waveform and falling waveform, as shown in graph (j) of the figure.

Now, saying that a sampling signal SR indicated in graph (k) of FIG. 9 has been supplied to the gate electrode of the TFT making up this switch, the switch is on in periods t7 through t13, the phase-rendered image signal VID3*b* is supplied to the data line 114*c*, and the switch goes off at the ending time Tz2 of the period t13. Accordingly, the application voltage on the data line 114*c* is determined by the signal level of the phase-rendered image signal VID3*b* at time Tz2.

In this example, the signal level of the phase-rendered image signal VID3*a* in the periods t7 through t12 is "Vb+K1(Vb−Vc)+K2(Vb−Vc)". That is, the signal level is greater by "K2(Vb−Vc)" as compared to the above-described first embodiment. This is because the data value of the future image data Dc must be taken into consideration, since the ending time Tz2 of the sampling signal SR2 occurs after periods t7 through t12.

In the event that, for example, the signal level of the phase-rendered image signal VID3*a* is "Vb+K1(Vb−Vc) as with the first embodiment, and the signal level of the phase-rendered image signal VID3*a* supplied to the data line 114*c* is "Vb" at the ending time Tz1 of the period t12, as shown in FIG. 6(*g*), due to the integrating effects of the image signal supplying line L3, the signal level at the ending time Tz2 of the period t13 is lower than "Vb", and thus is displaced from the desired signal level.

However, with the present embodiment, the current image data Da is corrected by the second correction data Dh2 reflecting the effects of the future image data Dc, and so the signal level of the phase-rendered image signal VID3*a* is "Vb" at the ending time Tz2 as shown in FIG. 9(*j*). In other words, the coefficient K2 is determined so as to capture change in the signal waveform between the starting point of the period t13 to the time Tz.

Thus, according to the present embodiment, ghost components can be predicted based on present, past, and future image data Da, Db, and Dc, and the present image data Da is corrected correspondingly, so that ghosts due to the image signals supplying lines L1 through L6 equivalently forming a low-pass filter can be cancelled, thereby greatly improving the image quality of the display image.

Figure 10:
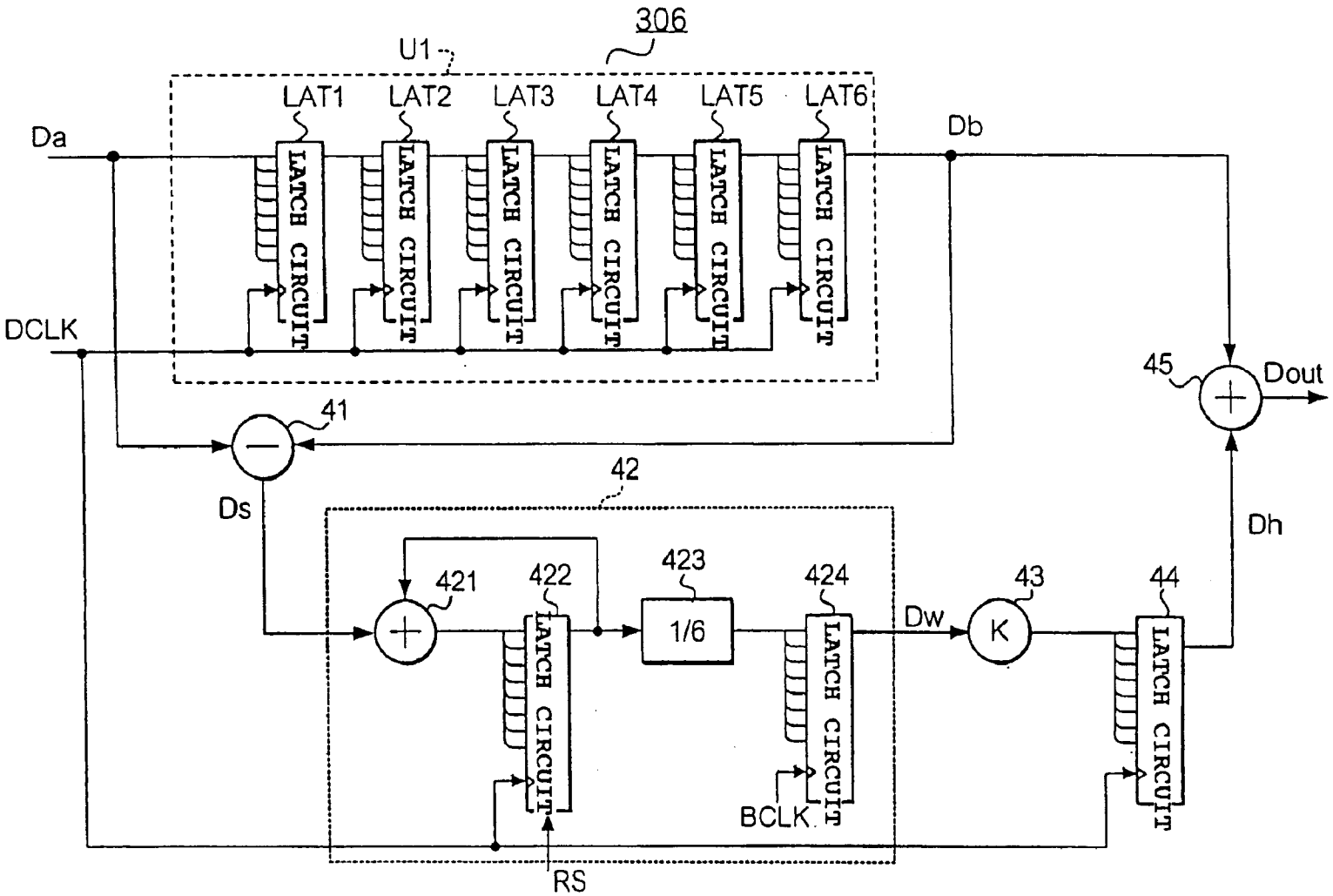
FIG. 10 is a block diagram illustrating a primary configuration of a ghost removing circuit used in a liquid crystal display device according to a representative third embodiment of the present invention.

Next, the liquid crystal display device according to the third embodiment will be described. This liquid crystal display device is similar to the liquid crystal display device according to the first embodiment shown in FIG. 1, except that a ghost removing circuit 306 is used instead of the ghost removing circuit 304. FIG. 10 is an exemplary block diagram illustrating the configuration of the ghost removing circuit 306 according to the third embodiment.

The ghost removing circuit 306 according to the third embodiment is used for removing ghosts occurring due to the parasitic capacity of the data lines 114*a* through 114*f* linking.

As shown in FIG. 10, the ghost removing circuit 306 comprises a first delay unit U1, a subtracting circuit 41, an averaging circuit 42, a coefficient circuit 43, a latch circuit 44, and an adding circuit 45.

First, the first delay unit U1 is used for generating image data Db extended one block period as to the image data Da. With the image data Da as current data here, the image data Db is similar to past data from one unit time back.

Next, the subtracting circuit 41 subtracts the current image data Da from the past image data Db, and generates difference image data Ds.

Next, the averaging circuit 42 is arranged so as to average the difference image data Ds for each block, and generate averaged image data Dw. This averaging circuit 42 has an adding circuit 421 and a latch circuit 422. The latch circuit 422 latches the output signals of the adding circuit 421, based on the dot clock signals DCLK. On the other hand, the difference image data Ds is supplied to one input terminal of the adding circuit 421, and the other input terminal receives feedback of output data from the latch circuit 422. Accordingly, the adding circuit 421 and the latch circuit 422 serve as an accumulating adding circuit. Also, a reset signal RS of six dot clock cycles is supplied to the reset terminal R of the latch circuit 422. Accordingly, the difference image data Ds is accumulated and added each unit time.

Also, the averaging circuit 42 comprises a dividing circuit 423 and a latch circuit 424. The dividing circuit 423 divides the data obtained by accumulating the difference image data Ds in increments of blocks by "6" (the number of phases), and further the latch circuit 424 latches the output data of the dividing circuit 423 with the block clock signal BCLK which becomes active each unit time, and outputs this as averaged image data Dw. Incidentally, the block clock signal BCLK is generated at the timing circuit 200 shown in FIG. 1.

Next, the coefficient circuit 43 has a multiplier, and multiples the averaged image data Dw by a coefficient K, and outputs this.

Next, the latch circuit 44 is used for setting time, and latches the output data of the coefficient circuit 43 and outputs this as correction data Dh.

Next, the adding circuit 45 adds the image data Dc and correction data Dh, and outputs this as corrected data Dout.

Other configurations are similar to those of the conventional liquid crystal display device, and accordingly no further explanation is required.

Figure 11:
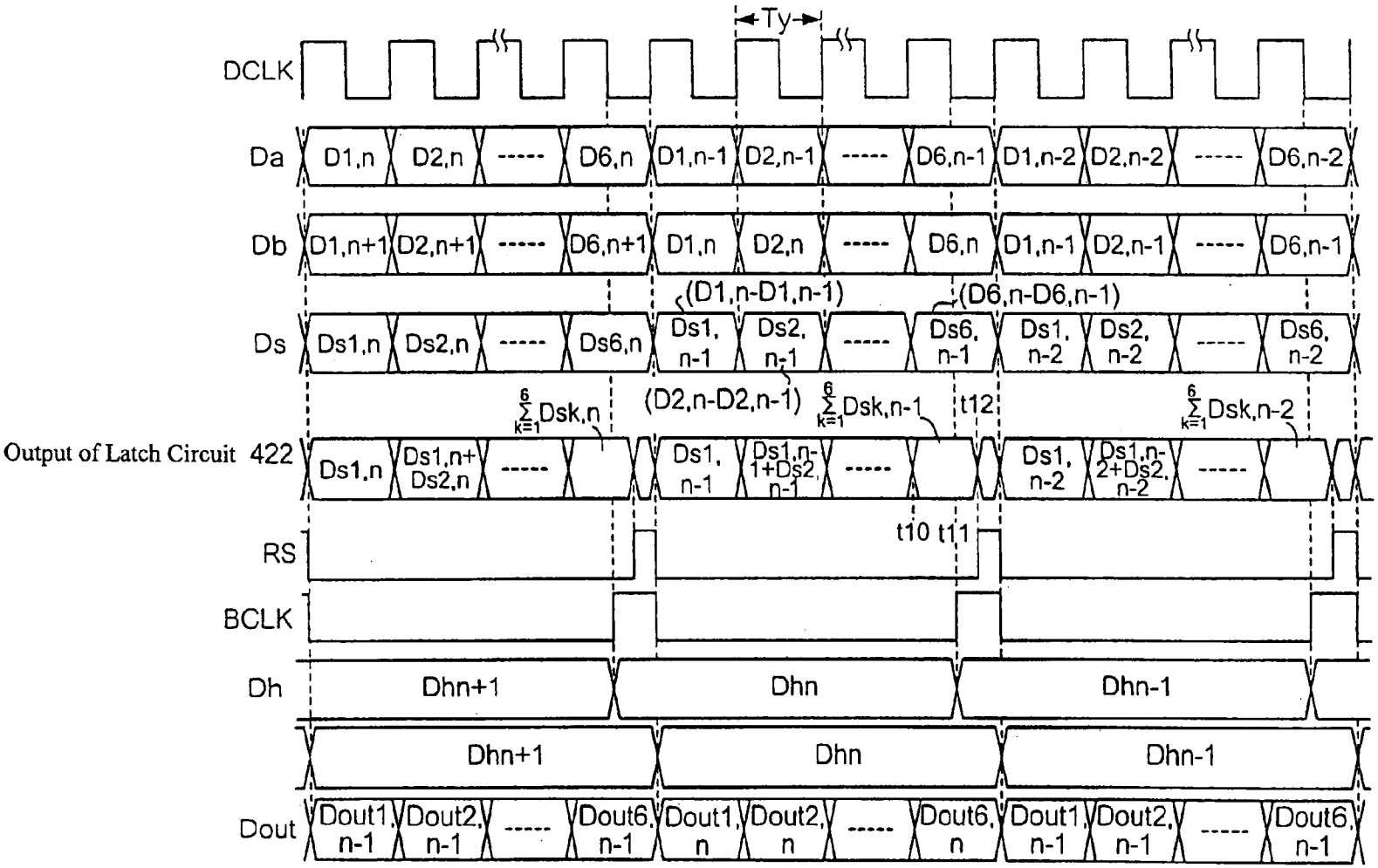
FIG. 11 is a timing chart illustrating the operation of the ghost removing circuit.

Next, the operation of the ghost removing circuit 306 will be described. FIG. 11 is an exemplary timing chart for describing the operation of the ghost removing circuit 306. Incidentally, with regard to expressions DX, Y, in this figure, the appended symbol X represents which number a data line 114 is counted in order in the scanning direction of the block within a particular block. On the other hand, the appended symbol Y represents which number the block is. For example, D1, n+1 represents corresponding to the No. 1 data line 114*a* in the block, and the block is the n+1'th block.

As shown in FIG. 11, the image data Db is the image data Da delayed by one unit time (six dot clock cycles). When these image data Da and Db are supplied to the subtracting circuit 41, the subtracting circuit 41 subtracts the image data Db (past: one block back) from the image data Da (present), and generates difference image data Ds. For example, with the period Ty shown in the figure, the image data Db is "D2, n", and the image data Da is "D2, n−1", so the difference image data Ds is "D2, n−D2, n−1"

Figure 14:
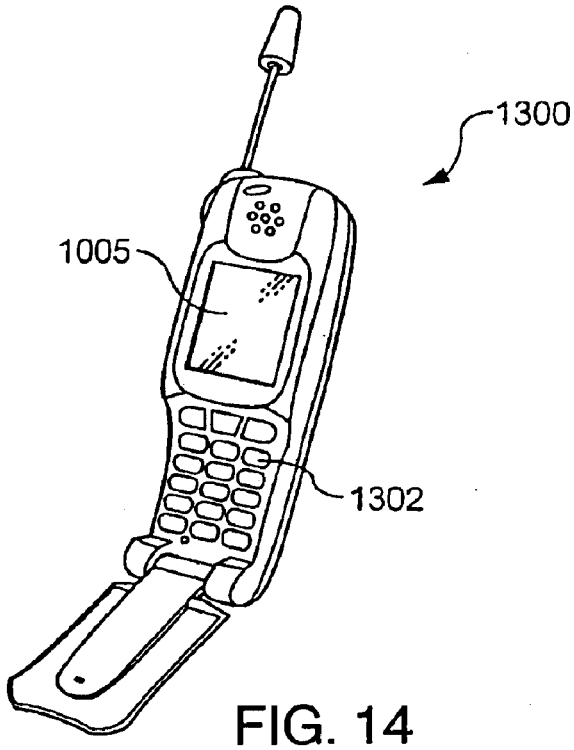
FIG. 14 is a perspective view illustrating the configuration of a cellular phone as an example of an electronic apparatus to which the liquid crystal display device has been applied.

As shown in FIG. 16, the data lines 114*a* through 114*f* in one block are joined by capacity, so in the event that there is change to image signals VID applied to one of the data lines 114, the voltage Vx changes. Due to this, the potential of the other data lines 114 changes, and the entire block is affected. Also, as shown in FIG. 14, in the event that the image signal VID3 supplied to the data line 114*c* changes from the black level to the intermediate level, the voltage Vx is given as the differential of the image signal VID3. Here, the amount of change in the voltage Vx is proportionate to the voltage value from which the image signal VID from one block back (past) has been subtracted.

With the present embodiment, the image data is corrected so as to cancel out the change in the voltage Vx. To this end, the following conditions are necessitated. Firstly, image signals VID must be generated in a manner so as to be applied to data lines 114 with voltage in the reverse direction as to the direction of change in the voltage Vx. Accordingly, there is the need to correct the present image data based on a data value obtained by subtracting the current image data from the image data from one block back (past). With the image data Da as the present data, the image data Db is image data from one block back (past). Thus, there is the need to correct based on the above-described difference image data Ds.

Secondly, there is the need to average the difference image data Ds within the block and make corrections based on the results thereof, since the change in the image signals VID applied to a particular data line 114 within a block affects the potential of the other data lines 114. The averaging circuit 42 is used to satisfy the second condition.

The difference image data Ds is accumulated and added by the adding circuit 421 and the latch circuit 422 within the averaging circuit 42, and so the output data of the latch circuit 422 corresponding to the data line 114*f* selected last within the block is the accumulation of the difference image data Ds within the block. For example, the output data of the latch circuit 422 in the period from time t10 through time 12 is Ds1, n−1+Ds2, n−1+. . . Ds6, n−1.

The output data of the latch circuit 422 is divided by the dividing circuit 423, and the latch circuit 424 latches the division results based on the block clock signal BCLK, so the latch circuit 424 generates averaged image data Dw before the output data of the latch circuit 422 is reset. In the example shown in FIG. 11, in the event that the block clock signal BCLK rises from low level to high level at the time 11, the latch circuit 424 generates averaged image data Dwn−1 synchronously at the rising edge thereof. Subsequently, at time t12, the reset signal RS becomes active (high level), so the output data of the latch circuit 422 is reset, and prepares for accumulation of the difference image data Ds of the next block.

Then, once the averaged image data Dw is supplied to the coefficient circuit 43, the averaged image data Dw is multiplied by the coefficient K, thereby generating correction data Dh. However, this correction data Dh is off-phase from the image data Db. Accordingly, the latch circuit 44 latches the correction data Dh output from the coefficient circuit 43 with the dot clock signal DCLK, and matches the phase of the correction data Dh to the phase of the image data Db. Subsequently, the adding circuit 45 generates corrected image data Dout by adding the image data Db and the correction data Dh.

Thus, according to the present embodiment, correction data Dh predicted beforehand for each block is generated for the second ghost component which occurs due to the parasitic capacities Ca through Cf of the data lines 114*a* through 114*f* of one block joining, and the image data Db is corrected based on this correction data Dh, so the second ghosting can be cancelled. Consequently, the image quality of the display image can be greatly improved.

It is to be understood that while specific embodiments and elements have been described, variations of the embodiments are possible. For example, in the above-described embodiments, a D/A converter 301 was provided between the ghost removing circuit 304 through 306 and the phase rendering circuit 302, but an arrangement may be made wherein one of the phase rendering circuit 302 and the amplifying/inverting circuit 303 is configured of a digital circuit, with a D/A converter 301 provided at the output thereof.

Further, in the above-described embodiments, the phase rendering circuit 302 comprises a first sample hold unit USa and a second sample hold unit USb, wherein the phase of the signals vid1 through vid6 are matched by the second sample hold unit USb, but the second sample hold unit USb may be omitted. In this case, the signals vid1 through vid6 with the phase thereof off by one dot clock cycle each (see FIG. 5) should be output as phase-rendered image signals VID1 through VID6.

Next, several examples of electronic apparatuses, wherein the liquid crystal display device described above with regard to the embodiments has been used, will be described.

Figure 12:
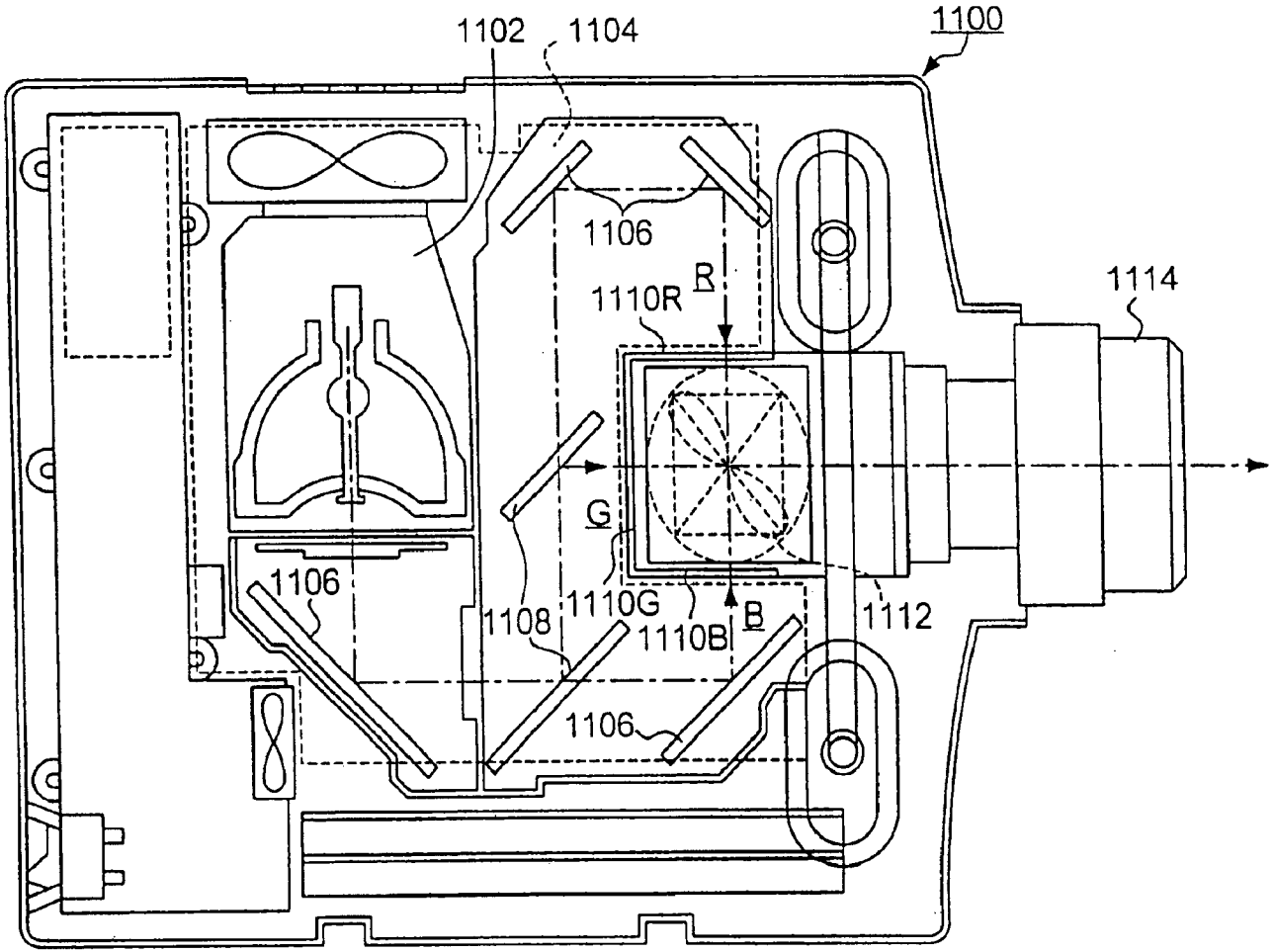
FIG. 12 is a cross-sectional diagram illustrating the configuration of a projector as an example of an electronic apparatus to which the liquid crystal display device has been applied.

First, a projector using the liquid crystal display device as a light valve will be described. FIG. 12 is a plan view illustrating a configuration example of the projector. As shown, a lamp unit 1102 of a white light source such as a halogen lamp is provided within the projector 1100. Projection light projected from the lamp unit 1102 is split into the three primary RGB colors by four mirrors 1106 and two dichroic mirrors 1108 positioned within a light guide, and cast into liquid crystal panels 1110R, 1110B, and 1110G, each serving as light valves corresponding to their respective primary colors.

The configuration of the liquid crystal panels 1110R, 1110B, and 1110G is the same as that of the above-described liquid crystal display panel 100, and each one is driven by primary color signals for R, G, and B, supplied from an unshown image signal processing circuit. Now, light modulated by these liquid crystal panels is cast into a dichroic prism 1112 from three directions. At this dichroic prism 1112, the light of R and B is bent at a 90° angle, while the light of G proceeds straight. Accordingly, as a result of the images of each color being synthesized, a color image is projected on a screen or the like via a projecting lens 1114.

Also, light corresponding to the primary colors of R, G, and B is cast into the liquid crystal panels 1110R, 1110B, and 1110G by the dichroic mirror 1108, so there is no need to provide a color filter upon the opposing substrate.

As described above, a ghost removing circuit 304 or 305 is used with the image processing circuit 300 of the liquid crystal display device, and accordingly the first or second ghosts can be cancelled, thereby greatly improving the image quality of the display image.

Figure 13:
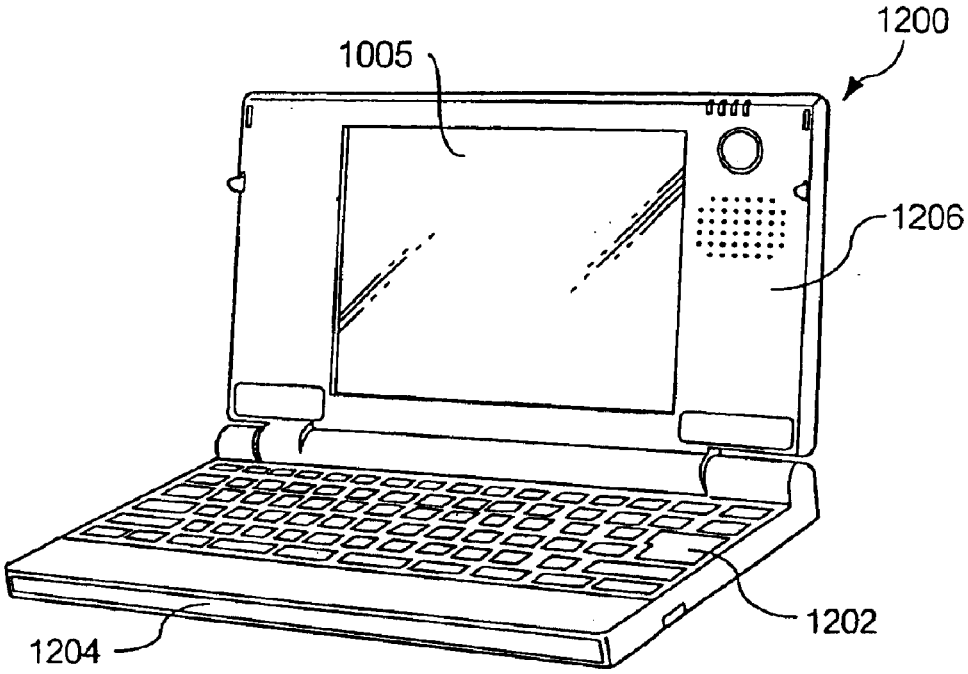
FIG. 13 is a perspective view illustrating the configuration of a personal computer as an example of an electronic apparatus to which the liquid crystal display device has been applied.

Next, an example of applying the liquid crystal display device to a mobile computer will be described. FIG. 13 is a frontal view illustrating the configuration of the computer. The computer 1200 is made up of a main unit 1204 having a keyboard 1202, and a liquid crystal display 1206. This liquid crystal display 1206 is configured by adding a backlight to the rear of the above-described liquid crystal display panel.

Further, an example of applying the liquid crystal display device to a cellular phone will be described. FIG. 14 is a perspective view illustrating the configuration of the cellular phone. In the figure, the cellular phone 1300 has a plurality of operating buttons 1302, and a reflection type liquid crystal panel 1005. A front light is provided to the front side of the liquid crystal panel 1005 if necessary.

In addition to the electronic apparatuses described with reference to FIG. 12 through FIG. 14, various examples can be given, such as liquid crystal televisions, viewfinder type or monitor-viewed video cassette recorders, car navigation devices, pagers, electronic notebooks, calculators, word processors, workstations, TV telephones, POS terminals, devices using touch panels, and so forth. It is needless to say that this is applicable to these various types of electronic apparatuses.

As described above, according to the present invention, in the event of supplying image signals, divided into multiple systems and extended in the time-axial direction and maintaining a constant signal level each unit time, to the data lines at a predetermined timing, ghosts appearing on the display image are predicted beforehand, and the image data is corrected so as to cancel this, thereby greatly improving the image quality of the display image.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An image processing circuit for use with an electro-optical device, said circuit comprising:

a delay circuit that delays externally supplied image data by a unit time and outputs the delayed data as first delayed image data;

a difference circuit that generates the difference image data based on a difference between said first delayed image data and said image data;

a multiplying circuit that generates correction data by multiplying said difference image data by a coefficient;

a generating circuit that synthesizes said image data and said correction data to generate corrected image data;

a phase rendering circuit that divides said corrected image data being input in a time-sequence into a plurality of phases;

a plurality of switching devices that samples image signals subjected to phase rendering according to sampling signals and supplies the sampled image signals to data lines; and image signals supplying lines that supply said image signals to said switching devices, said coefficient being set so that a signal level corresponding to a predetermined image signal among the image signals supplied to the data line reaches a predetermined value when an active period of the sampling signal is finished.

2. The image processing circuit according to claim 1, an active period of said sampling signals ending within a current unit time of said image signals.

3. An electro-optical device, comprising:

an image processing circuit according to claim 1;

an image signal generating circuit that generates image signals divided into multiple systems and extended in the time-axial direction and maintains a constant signal level each unit time based on said corrected image data;

a data line driving circuit that sequentially generates said sampling signals; and a sampling circuit that samples said image signals based on said sampling signals and supplies the sampled image signals to said data lines.

4. An electronic apparatus comprising an electro-optical device according to claim 3.

5. An image processing circuit for use with an electro-optical device, said circuit comprising:

a first delay circuit that delays externally supplied image data by a unit time of said image signals and outputs the delayed data as first delayed image data;

a second delay circuit that delays said first delayed image data by a unit time of said image signals and outputs the twice delayed image data as second delayed image data;

a first difference circuit that generates first difference image data based on a difference between said first delayed image data and said second delayed image data;

a first multiplying circuit that generates first correction data based on multiplying said first difference image data by a first coefficient;

a second difference circuit that generates second difference image data based on a difference between said first delayed image data and said image data;

a second multiplying circuit that generates second correction data based on multiplying said second difference image data by a second coefficient;

a synthesizing circuit that synthesizes said first delayed image data, said first correction data, and said second correction data, to generate corrected image data; and a phase rendering circuit that divides said corrected image data being input in a time-sequence into a plurality of phases.

6. The image processing circuit according to claim 5, said electro-optical device comprising:

a plurality of switching devices that sample image signals subjected to phase rendering according to sampling signals and supply the sampled signals to data lines; and image signals supplying lines that supply said image signals to said switching devices;

said first coefficient and said second coefficient being determined according to low-pass filter properties based on said image signals supplying lines.

7. The image processing circuit according to claim 6, an active period of said sampling signals starts in a current unit time of said image signals and ends in a next unit time.

8. An electro-optical device, comprising:

an image processing circuit according to claim 5;

an image signal generating circuit that generates image signals divided into multiple systems and extended in the time-axial direction and maintains a constant signal level each unit time based on said corrected image data;

a data line driving circuit that generates said sampling signals; and a sampling circuit that samples said image signals based on said sampling signals and supplies the sampled image signals to said data lines.

9. An electronic apparatus comprising an electro-optical device according to claim 8.

10. An image data processing method for use with an electro-optical device, comprising:

taking externally supplied image data as future image data and sequentially delaying said externally supplied image data by a unit time so as to generate current image data and past image data;

generating first correction data based on difference data value between said current image data and said past image data;

generating second correction data based on difference data value between said current image data and said future image data;

synthesizing said current image data, said first correction data, and said second correction data, to generate corrected image data; and dividing said corrected image data into multiple systems and extending in the time-axial direction, and supplying the image signals maintaining a constant signal level each unit time at a predetermined timing to a plurality of data lines.

11. An image processing circuit for use with an electro-optical device, said image processing circuit comprising:

a delay circuit that delays externally supplied image data by a unit time and outputs delayed image data;

a difference circuit that generates the difference between said delayed image data and said image data as difference image data;

an averaging circuit that accumulates and adds said difference image data and divides for number of phases and generates averaged image data;

a correcting circuit that corrects said delayed image data based on said averaged image data and generates corrected image data; and a phase rendering circuit that divides said corrected image data being input in a time-sequence into a plurality of phases.

12. The image processing circuit according to claim 11, said averaging circuit comprising:

an accumulating adder that accumulates and adds said difference image data each unit time; and a divider that divides the output data of said accumulating adder by the number of said plurality of systems.

13. The image processing circuit according to claim 11, said correcting circuit comprising:

a coefficient unit that multiplies said averaged image data by a coefficient; and an adder that adds said delayed image data and the output data of said coefficient unit.

14. An electro-optical device, comprising:

an image processing circuit according to claim 11;

an image signal generating circuit that generates image signals divided into multiple systems and extended in the time-axial direction and maintains a constant signal level each unit time based on said corrected image data;

a data line driving circuit that generates said sampling signals; and a sampling circuit that samples said image signals based on said sampling signals and supplies the sampled image signals to said data lines.

15. An electronic apparatus comprising an electra-optical device according to claim 14.

16. An image data processing method for use with an electro-optical device, said image data processing method comprising:

delaying externally supplied image data by a unit time and generating delayed image data;

generating a difference between said delayed image data and said image data as difference image data;

averaging said difference image data by accumulating and adding said difference image data and dividing for number of phases and generating averaged image data;

correcting said delayed image data based on said averaged image data and generating corrected image data; and dividing said corrected image data into multiple systems and extending in the time-axial direction, and supplying the image signals maintaining a constant signal level each unit time at a predetermined timing to a plurality of data lines.

17. An image processing circuit for use with an electro-optical device, said image processing circuit comprising:

a delay circuit that delays externally supplied image data by a unit time and outputs delayed image data;

a difference circuit that generates the difference between said delayed image data and said image data as difference image data;

an averaging circuit that averages said difference image data each unit time and generates average image data;

a correcting circuit that corrects said delayed image data based on said averaged image data and generates corrected image data; and a phase rendering circuit that divides said corrected image data being input in a time-sequence into a plurality of phases;

said averaging circuit including:

an accumulating adder that accumulates and adds said difference image data each unit time; and a divider that divides the output data of said accumulating adder by the number of said plurality of systems.

18. An image processing circuit for use with an electro-optical device, said image processing circuit comprising:

a delay circuit that delays externally supplied image data by a unit time and outputs delayed image data;

a difference circuit that generates the difference between said delayed image data and said image data as difference image data;

an averaging circuit that averages said difference image data each unit time and generates averaged image data;

a correcting circuit that corrects said delayed image data based on said averaged image data and generates corrected image data; and a phase rendering circuit that divides said corrected image data being input in a time-sequence into a plurality of phases;

said correcting circuit including:

a coefficient unit that multiplies said averaged image data by a coefficient; and an adder that adds said delayed image data and the output data of said coefficient unit.

* * * * *